US008390656B2

(12) United States Patent
Muroi et al.

(10) Patent No.: US 8,390,656 B2
(45) Date of Patent: Mar. 5, 2013

(54) IMAGE DISPLAY DEVICE AND IMAGE DISPLAY METHOD

(75) Inventors: Takao Muroi, Osaka (JP); Kohji Fujiwara, Osaka (JP); Takayuki Murai, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 319 days.

(21) Appl. No.: 12/997,645

(22) PCT Filed: Jun. 4, 2009

(86) PCT No.: PCT/JP2009/060230

§ 371 (c)(1),
(2), (4) Date: Dec. 13, 2010

(87) PCT Pub. No.: WO2010/001681

PCT Pub. Date: Jan. 7, 2010

(65) Prior Publication Data

US 2011/0090265 A1 Apr. 21, 2011

(30) Foreign Application Priority Data

Jul. 3, 2008 (JP) ..... 2008-174392

(51) Int. Cl.
*G09G 5/10* (2006.01)
*G09G 3/36* (2006.01)

(52) U.S. Cl. ..... 345/690; 345/102

(58) Field of Classification Search ..... 345/102, 345/690

See application file for complete search history.

(56) References Cited

U.S. PATENT DOCUMENTS

| | | | | |
|---|---|---|---|---|
| 7,859,499 | B2 * | 12/2010 | Furukawa | 345/88 |
| 8,004,545 | B2 * | 8/2011 | Inuzuka et al. | 345/690 |
| 8,044,980 | B2 * | 10/2011 | Shimodaira | 345/690 |
| 2005/0057539 | A1 | 3/2005 | Ong | |
| 2005/0231457 | A1 | 10/2005 | Yamamoto et al. | |
| 2006/0007103 | A1 | 1/2006 | Oh et al. | |
| 2006/0256257 | A1 | 11/2006 | Nakano et al. | |
| 2006/0262078 | A1 | 11/2006 | Inuzuka et al. | |
| 2008/0150880 | A1 | 6/2008 | Inuzuka et al. | |

FOREIGN PATENT DOCUMENTS

| | | | |
|---|---|---|---|
| JP | 2005-17324 | A | 1/2005 |
| JP | 2005-234134 | A | 9/2005 |

(Continued)

OTHER PUBLICATIONS

Hendriek Groot Hulze, et al., "51.3: Driving an Adaptive Local Dimming Backlight for LCD-TV Systems," NXP Semiconductors, Research/Systems and Algorithms, Eindhoven, Netherlands, SID 08 Digest, pp. 772-775, May 18, 2008.

*Primary Examiner* — Jimmy H Nguyen
(74) *Attorney, Agent, or Firm* — Birch, Stewart, Kolasch & Birch, LLP

(57) ABSTRACT

There is provided an image display device capable of suppressing the occurrence of a color shift while ensuring a sufficient color reproduction range. An in-area maximum luminance obtaining unit (151) divides an input image (31) into a plurality of areas and obtains, for each of RGB colors, a maximum luminance value (34) in each area. A weighting coefficient calculating unit (152) obtains the maximum luminance values (34) for the respective RGB colors for all of the areas, and determines weighting coefficients (35) which are required upon an LED luminance adjustment process, based on an mean value of the maximum luminances values (34) for each color. An LED luminance adjusting unit (153) adjusts the luminances of respective RGB color LEDs in each area to suppress the occurrence of a color shift, based on the maximum luminance values (34) obtained by the in-area maximum luminance obtaining unit (151) and the weighting coefficients (35) determined by the weighting coefficient calculating unit (152).

12 Claims, 20 Drawing Sheets

FOREIGN PATENT DOCUMENTS

| | | | |
|---|---|---|---|
| JP | 2005-338857 | A | 12/2005 |
| JP | 2006-323130 | A | 11/2006 |
| JP | 2006-343716 | A | 12/2006 |
| JP | 2007-279395 | A | 10/2007 |
| JP | 2008-102379 | A | 5/2008 |
| RU | 2310926 | C1 | 11/2007 |

* cited by examiner

IMAGE DISPLAY DEVICE AND IMAGE DISPLAY METHOD

TECHNICAL FIELD

The present invention relates to an image display device and more particularly to an image display device having the function of controlling the luminance of a backlight (backlight dimming function).

BACKGROUND ART

In image display devices having a backlight such as liquid crystal display devices, by controlling the luminance of the backlight based on an input image, the power consumption of the backlight can be suppressed and the image quality of a displayed image can be improved. In particular, by dividing a screen into a plurality of areas and controlling, based on an input image in an area, the luminance of backlight light sources provided in the area, a further reduction in power consumption and a further improvement in image quality can be achieved. A method of driving a display panel while thus controlling the luminance of backlight light sources based on an input image in each area is hereinafter referred to as "area active drive".

A liquid crystal display device that performs area active drive uses, for example, LEDs (Light Emitting Diodes) of three RGB colors or white LEDs, as backlight light sources. The luminances of LEDs provided in each area are determined based on the highest value and mean value of the luminances of pixels in the area, etc. The determined luminances are provided to a backlight drive circuit as LED data. In addition, based on the LED data and an input image, display data (data for controlling the light transmittances of liquid crystals) is generated, and the display data is provided to a liquid crystal panel drive circuit. Note that the luminance of each pixel on a screen is the product of the luminance of light from a backlight and a light transmittance based on display data. Here, light emitted from a single LED hits a plurality of areas around a corresponding area. Thus, the luminance of each pixel is the product of the sum of the luminances of lights emitted from a plurality of LEDs and a light transmittance based on display data.

According to a liquid crystal display device such as that described above, suitable display data and LED data are obtained based on an input image, and the light transmittances of liquid crystals are controlled based on the display data, and the luminances of LEDs provided in respective areas are controlled based on the LED data, whereby the input image can be displayed on the liquid crystal panel. When the luminance of pixels in an area is low, by reducing the luminance of LEDs provided in the area, the power consumption of the backlight can be reduced.

Note that in relation to inventions pertaining to this subject the following prior art documents are known. Japanese Patent Application Laid-Open No. 2005-338857 discloses an invention of a liquid crystal display device that has a backlight unit including a plurality of LEDs, as a direct-type backlight. In the invention, by controlling the luminances of the LEDs according to peak gray level values in respective divided regions of a liquid crystal display panel, an improvement in image quality and a reduction in power consumption are achieved. Japanese Patent Application Laid-Open No. 2005-234134 discloses an invention of a liquid crystal display device that includes, as light sources, a white light source that emits lights of three wavelengths or more and an auxiliary light source using LEDs. The liquid crystal display device achieves widening of a color reproduction range by optimizing the wavelength selection characteristics of a wavelength selection filter. Japanese Patent Application Laid-Open No. 2006-343716 discloses an invention of a liquid crystal display device in which color reproduction capability is enhanced by switching between LEDs that radiate white light and LEDs of three RGB colors, according to the brightness around a liquid crystal panel. Japanese Patent Application Laid-Open No. 2005-17324 discloses an invention of a liquid crystal display device that adjusts white balance by controlling the amounts of light from LEDs of three RGB colors independently of one another.

PRIOR ART DOCUMENTS

Patent Documents

[Patent Document 1] Japanese Patent Application Laid-Open No. 2005-338857
[Patent Document 2] Japanese Patent Application Laid-Open No. 2005-234134
[Patent Document 3] Japanese Patent Application Laid-Open No. 2006-343716
[Patent Document 4] Japanese Patent Application Laid-Open No. 2005-17324

DISCLOSURE OF THE INVENTION

Problems to be Solved by the Invention

Meanwhile, for liquid crystal display devices that perform area active drive such as those described above, as backlight control schemes, the following two schemes start to be put to practical use. The first scheme is that gray levels are controlled only by white light (including not only light adjusted to white composed of blue and yellow but also light adjusted to white using LEDs of three RGB colors, etc.) according to input video signals. This scheme is hereinafter referred to as "black and white area active drive". The second scheme is that LEDs of three. RGB colors are controlled independently of one another. This scheme is hereinafter referred to as "RGB independent area active drive". In the RGB independent area active drive, since only those LEDs of colors required for video display emit light, a reduction in power consumption can be achieved over the black and white area active drive.

In the RGB independent area active drive, however, a chromaticity shift (color shift) is visually recognized depending on the transmission characteristics of color filters used in a liquid crystal panel, etc., and thus, it is difficult to improve light-emission quality. For example, when, as shown in FIG. 18A, display of a square pattern of a single yellow color with the highest gray level is performed in the center of a gray background with 64 gray levels (when display is performed such that a portion indicated by reference numeral P1 is yellow and portions indicated by reference numerals P2 and P3 are gray), a large amount of light from G color (green) LEDs is transmitted through B (blue) color filters. Thus, as shown in FIG. 18B, a color shift of cyan occurs around the square pattern of a single yellow color (the portion indicated by reference numeral P2 turns cyan). At this time, the portion indicated by reference numeral P2 and the portion indicated by reference numeral P3 are supposed to have the same coordinates in an xy chromaticity diagram defined by "CIE1931" but have different coordinates, as shown in FIG. 19. A cause of the occurrence of such a color shift is as follows. A relationship between the light transmission characteristics of RGB color filters and the wavelength of light emitted from LEDs is as shown in FIG. 20, and, for example, lights of wavelengths for the colors B and R are transmitted through the G color filter.

When the black and white area active drive (drive is performed by white LEDs on an area-by-area basis or LEDs of three RGB colors are driven at the same gray level) is adopted, although the problem of a color shift is resolved, the color reproduction range is narrower than that in the RGB independent area active drive. For example, in an xy chromaticity diagram shown in FIG. 21, when each of the RGB LEDs emits light as a single color, a color reproduction range indicated by reference numeral 91 is obtained, and in the RGB independent area active drive, a color reproduction range indicated by reference numeral 92 is obtained, and in the black and white area active drive, a color reproduction range indicated by reference numeral 93 is obtained. As such, since the color reproduction range is narrow in the black and white area active drive, sharp display is not performed. In addition, in the black and white area active drive, power consumption is higher than that in the RGB independent area active drive.

As described above, in conventional image display devices, a color shift may occur upon image display based on input video signals, or an image with vibrant color which is a feature of LEDs may not be displayed. In addition, it is difficult to improve color reproducibility, and display quality is not sufficiently improved.

An object of the present invention is therefore to provide an image display device capable of suppressing the occurrence of a color shift while ensuring a sufficient color reproduction range.

Means for Solving the Problems

A first aspect of the present invention is directed to an image display device having a function of controlling a luminance of a backlight, the image display device comprising:

a display panel including a plurality of display elements;

a backlight including a plurality of light sources of three RGB colors;

an in-area maximum luminance obtaining unit that divides an input image into a plurality of areas and obtains, based on a portion of the input image in each area, maximum luminances for the respective RGB colors in the area, as first light-emission luminances;

a weighting coefficient calculating unit that determines weighting coefficients to be used in calculation of second light-emission luminances, based on first light-emission luminances for the three RGB colors in the plurality of areas, the second-light emission luminances indicating luminances of light sources of the three RGB colors in each area upon light emission;

a light-emission luminance correcting unit that extracts, in each area, a color with a highest first light-emission luminance among the three RGB colors as a reference color, and determines, in the each area, second light-emission luminances for colors other than the reference color based on correction luminances obtained by multiplying the first light-emission luminance for the reference color by predetermined coefficients and the weighting coefficients;

a display data calculating unit that obtains display data for controlling light transmittances of the display elements, based on backlight control data and the input image, the backlight control data including data representing first light-emission luminances for the reference color and data representing second light-emission luminances for the colors other than the reference color which are determined by the light-emission luminance correcting unit;

a panel drive circuit that outputs, based on the display data, signals for controlling the light transmittances of the display elements to the display panel; and a backlight drive circuit that outputs, based on the backlight control data, signals for controlling luminances of the light sources to the backlight.

According to a second aspect of the present invention, in the first aspect of the present invention, the light-emission luminance correcting unit determines, for each of the colors other than the reference color, a correction luminance for the color as a second light-emission luminance for the color when a first light-emission luminance for the color is lower than the correction luminance for the color.

According to a third aspect of the present invention, in the first aspect of the present invention, the weighting coefficient calculating unit determines, for each of the three RGB colors, a maximum luminance mean value which is a mean value of first light-emission luminances in the plurality of areas, and calculates a weighting coefficient W for a color with a highest maximum luminance mean value among the three RGB colors by a following equation:

$$W=I\times(Ma/Mb)+m$$

where I and m represent constants which are set externally, Ma represents any one of the maximum luminance mean values for the three RGB colors, and Mb represents any one of the maximum luminance mean values for the three RGB colors other than the Ma.

According to a fourth aspect of the present invention, in the third aspect of the present invention, the Ma represents a second highest value among the maximum luminance mean values for the three RGB colors, and the Mb represents a highest value among the maximum luminance mean values for the three RGB colors.

According to a fifth aspect of the present invention, in the third aspect of the present invention, the weighting coefficient calculating unit sets 1 to weighting coefficients for colors other than the color with the highest maximum luminance mean value among the three RGB colors.

According to a sixth aspect of the present invention, in the third aspect of the present invention, when values for any two or three colors among the maximum luminance mean values for the three RGB colors are equal, the weighting coefficient calculating unit determines rankings of magnitude of the values in following priority rankings: the color B; the color G; and the color R.

A seventh aspect of the present invention is directed to an image display method for an image display device having a display panel including a plurality of display elements; and a backlight including a plurality of light sources of three RGB colors, the method comprising:

an in-area maximum luminance obtaining step of dividing an input image into a plurality of areas and obtaining, based on a portion of the input image in each area, maximum luminances for the respective RGB colors in the area, as first light-emission luminances;

a weighting coefficient calculating step of determining weighting coefficients to be used in calculation of second light-emission luminances, based on first light-emission luminances for the three RGB colors in the plurality of areas, the second-light emission luminances indicating luminances of light sources of the three RGB colors in each area upon light emission;

a light-emission luminance correcting step of extracting, in each area, a color with a highest first light-emission luminance among the three RGB colors as a reference color, and determining, in the each area, second light-emission luminances for colors other than the reference color based on correction luminances obtained by multiplying the first light-emission luminance for the reference color by predetermined coefficients and the weighting coefficients;

a display data calculating step of obtaining display data for controlling light transmittances of the display elements, based on backlight control data and the input image, the backlight control data including data representing first light-emission luminances for the reference color and data representing second light-emission luminances for the colors other than the reference color which are determined in the light-emission luminance correcting step;

a panel driving step of outputting, based on the display data, signals for controlling the light transmittances of the display elements to the display panel; and a backlight driving step of outputting, based on the backlight control data, signals for controlling luminances of the light sources to the backlight.

In addition, variants that are grasped by referring to the embodiment and the drawings in the seventh aspect of the present invention are considered to be means for solving the problems.

Effects of the Invention

According to the first aspect of the present invention, in each area, for those colors other than a color whose first light-emission luminance (the maximum luminance for each of the RGB colors in each area) is highest among RGB, second light-emission luminances (luminances of light sources upon light emission) are determined based on correction luminances. Hence, the luminances of LEDs of those colors other than the color with the highest first light-emission luminance can be made different from luminances based on an input image. Accordingly, the luminances of LEDs can be adjusted to suppress the occurrence of a color shift caused by spectral wavelength leakage. In addition, since the correction luminances are obtained by multiplying the first light-emission luminance by predetermined coefficients and predetermined weighting coefficients, the correction luminances are dynamically changed according to the input image. Therefore, by setting suitable values to the values of the predetermined coefficient and the weighting coefficient, the luminances of LEDs are suitably adjusted according to the input image, enabling to ensure a sufficient color reproduction range.

According to the second aspect of the present invention, in each area, for each of those colors among RGB other than the color with the highest first light-emission luminance, when a first light-emission luminance is lower than a correction luminance determined by the light-emission luminance correcting unit, the luminance of an LED is increased over a luminance obtained based on the input image. Hence, the overall luminance of LEDs of those colors other than the color with the highest first light-emission luminance is increased, and thus, the difference in the influence exerted (on image display) by spectral wavelength leakage between adjacent areas is smaller than that in conventional devices. Accordingly, the occurrence of a color shift caused by spectral wavelength leakage is suppressed.

According to the third aspect of the present invention, since weighting coefficients are calculated based on maximum luminance mean values for any two of RGB, the weighting coefficients are dynamically changed according to the input image. Hence, the luminances of LEDs are adjusted according to the input image. In addition, the weighting coefficients are adjusted according to values (I and m) which are set externally. Thus, the weighting coefficients can be relatively easily adjusted according to, for example, the characteristics of color filters or the characteristics of LEDs. Accordingly, an image display device is implemented that can relatively easily adjust weighting coefficients according to the characteristics of components in the device, and that suitably adjusts the luminances of LEDs according to an input image.

According to the fourth aspect of the present invention, as with the third aspect of the present invention, an image display device is implemented that can relatively easily adjust weighting coefficients according to the characteristics of components in the device, and that suitably adjusts the luminances of LEDs according to an input image.

According to the fifth aspect of the present invention, as with the third aspect of the present invention, an image display device is implemented that can relatively easily adjust weighting coefficients according to the characteristics of components in the device, and that suitably adjusts the luminances of LEDs according to an input image.

According to the sixth aspect of the present invention, weighting coefficients determined by the weighting coefficient calculating unit take into account the difference in the characteristics of color filters between the RGB colors and the difference in luminance between the RGB colors. Thus, a wider color reproduction range is ensured, and display of more vibrant color is performed in a portion with a high color signal value.

BEST MODE FOR CARRYING OUT THE INVENTION

An embodiment of the present invention will be described below with reference to the accompanying drawings.

<1. Overall Configuration and Overview of Operation>

Figure 2:
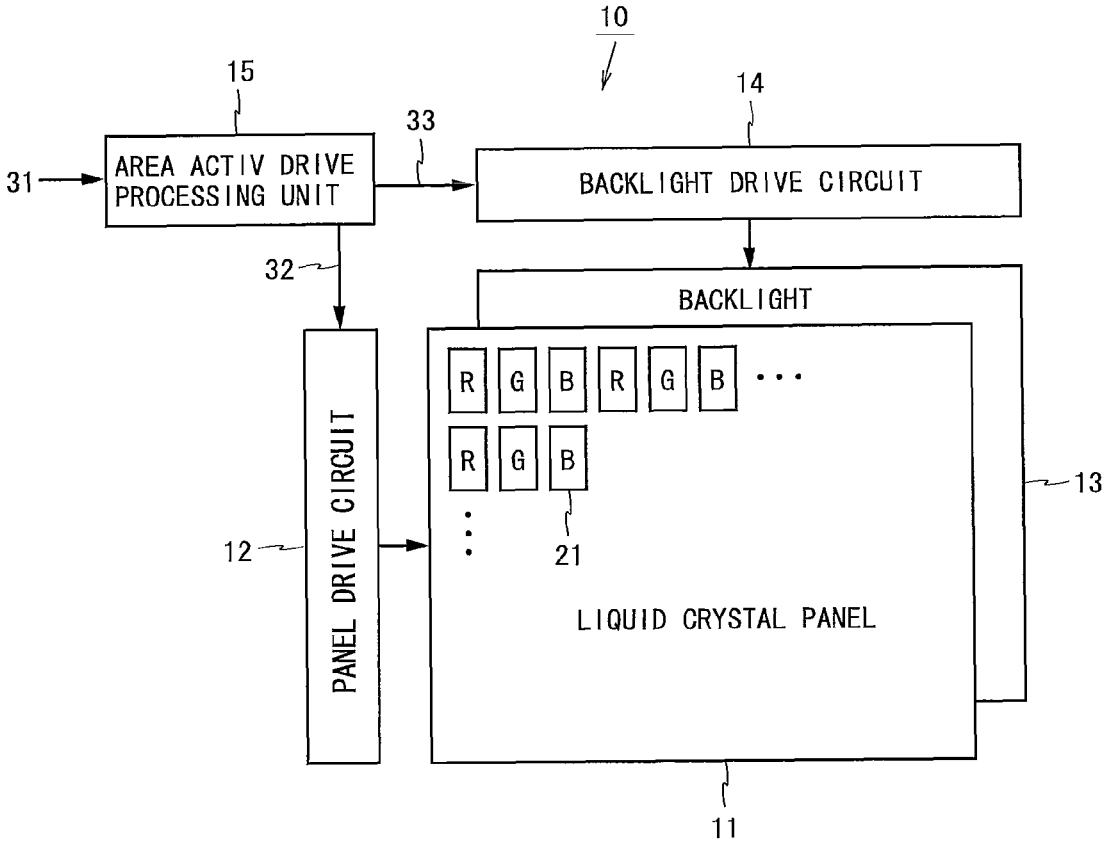
FIG. 2 is a block diagram showing a configuration of a liquid crystal display device according to the embodiment.

FIG. 2 is a block diagram showing a configuration of a liquid crystal display device 10 according to an embodiment of the present invention. The liquid crystal display device 10 shown in FIG. 2 includes a liquid crystal panel 11, a panel drive circuit 12, a backlight 13, a backlight drive circuit 14, and an area active drive processing unit 15. The liquid crystal display device 10 performs area active drive where a screen is divided into a plurality of areas and the liquid crystal panel 11 is driven while the luminances of backlight light sources are controlled based on an input image in each area. In the following, m and n are integers greater than or equal to 2, p and q are integers greater than or equal to 1, and at least one of p and q is an integer greater than or equal to 2.

An input image 31 including an R image, a G image, and a B image is inputted to the liquid crystal display device 10. Each of the R image, the G image, and the B image includes the luminances of (m×n) pixels. The area active drive processing unit 15 obtains, based on the input image 31, display data used to drive the liquid crystal panel 11 (hereinafter, referred to as liquid crystal data 32) and backlight control data used to drive the backlight 13 (hereinafter, referred to as LED data 33) (the detail of which will be described later).

The liquid crystal panel 11 includes (m×n×3) display elements 21. The display elements 21 as a whole are arranged two-dimensionally such that 3 m display elements 21 are arranged in a row direction (a horizontal direction in FIG. 2) and n display elements 21 are arranged in a column direction (a vertical direction in FIG. 2). The display elements 21 include R display elements that allow red light to be transmitted therethrough, G display elements that allow green light to be transmitted therethrough, and B display elements that allow blue light to be transmitted therethrough. The R display elements, the G display elements, and the B display elements are arranged side by side in the row direction, and three R, G, and B display elements form one pixel.

The panel drive circuit 12 is a circuit that drives the liquid crystal panel 11. The panel drive circuit 12 outputs to the liquid crystal panel 11 signals (voltage signals) for controlling the light transmittances of the display elements 21, based on the liquid crystal data 32 outputted from the area active drive processing unit 15. The voltages outputted from the panel drive circuit 12 are written into pixel electrodes in the display elements 21, and the light transmittances of the display elements 21 change according to the voltages written into the pixel electrodes.

Figure 3:
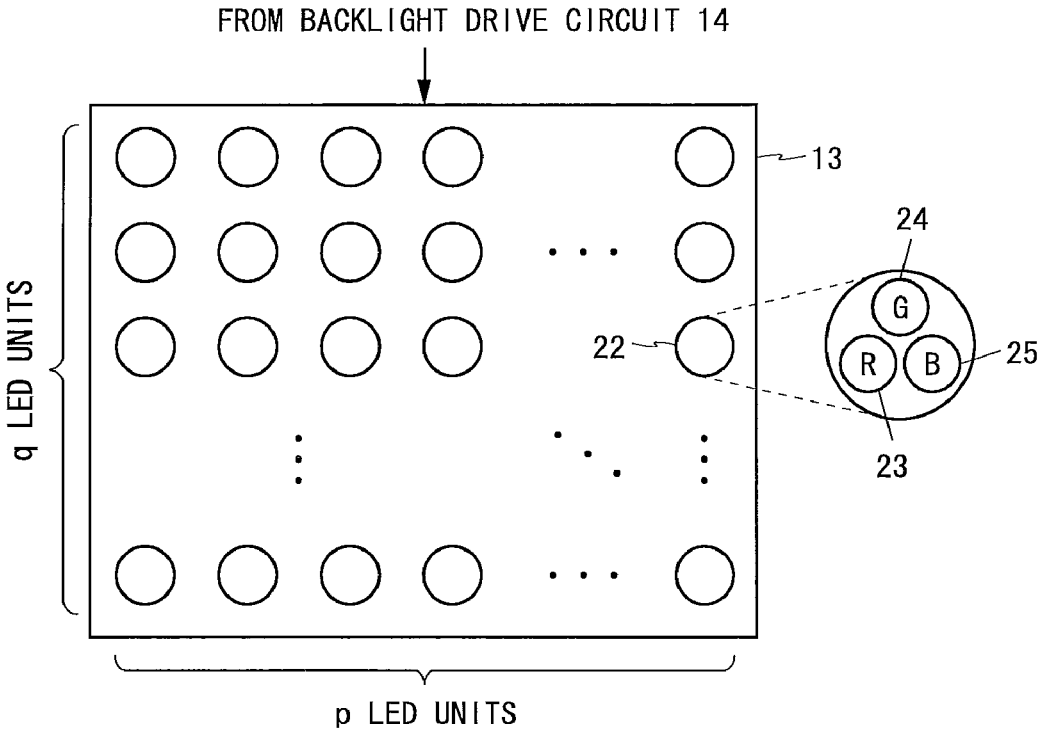
FIG. 3 is a diagram showing a detail of a backlight shown in FIG. 2.

The backlight 13 is provided on the back side of the liquid crystal panel 11 and irradiates the back of the liquid crystal panel 11 with backlight light. FIG. 3 is a diagram showing a detail of the backlight 13. As shown in FIG. 3, the backlight 13 includes (p×q) LED units 22. The LED units 22 as a whole are arranged two-dimensionally such that p LED units 22 are arranged in the row direction and q LED units 22 are arranged in the column direction. Each LED unit 22 includes one red LED 23, one green LED 24, and one blue LED 25. Lights emitted from three LEDs 23 to 25 included in one LED unit 22 hit a part of the back of the liquid crystal panel 11.

The backlight drive circuit 14 is a circuit that drives the backlight 13. The backlight drive circuit 14 outputs to the backlight 13 signals (voltage signals or current signals) for controlling the luminances of the LEDs 23 to 25 (second light-emission luminances), based on the LED data 33 outputted from the area active drive processing unit 15. The luminances of LEDs 23 to 25 are controlled independently of the luminances of LEDs inside and outside their unit.

A screen of the liquid crystal display device 10 is divided into (p×q) areas, and one LED unit 22 is corresponded to one area. The area active drive processing unit 15 determines, for each of the (p×q) areas, based on an R image in the area, a luminance of a red LED 23 corresponded to the area. Likewise, a luminance of a green LED 24 is determined based on a G image in the area. Likewise, a luminance of a blue LED 25 is determined based on a B image in the area. The area active drive processing unit 15 determines luminances of all of the LEDs 23 to 25 included in the backlight 13, and outputs LED data 33 representing the determined LED luminances to the backlight drive circuit 14. Note that in the present embodiment, in order to suppress the occurrence of a color shift while ensuring a sufficient color reproduction range, adjusting the luminances of backlight lights is performed in the area active drive processing unit 15.

In addition, the area active drive processing unit 15 determines, based on the LED data 33, luminances of backlight lights in all of the display elements 21 included in the liquid crystal panel 11. Furthermore, the area active drive processing unit 15 determines light transmittances of all of the display elements 21 included in the liquid crystal panel 11 based on the input image 31 and the luminances of the backlight lights, and outputs liquid crystal data 32 representing the determined light transmittances to the panel drive circuit 12.

In the liquid crystal display device 10, the luminance of an R display element is the product of the luminance of red light emitted from the backlight 13 and the light transmittance of the R display element. Light emitted from one red LED 23 hits a plurality of areas around a corresponding area. Thus, the luminance of an R display element is the product of the sum of the luminances of lights emitted from a plurality of red LEDs 23 and the light transmittance of the R display element. Likewise, the luminance of a G display element is the product of the sum of the luminances of lights emitted from a plurality of green LEDs 24 and the light transmittance of the G display element. Likewise, the luminance of a B display element is the product of the sum of the luminances of lights emitted from a plurality of blue LEDs 25 and the light transmittance of the B display element.

According to the liquid crystal display device 10 configured in the above-described manner, suitable liquid crystal data 32 and LED data 33 are obtained based on an input image 31, and the light transmittances of the display elements 21 are controlled based on the liquid crystal data 32, and the luminances of the LEDs 23 to 25 are controlled based on the LED data 33, whereby the input image 31 can be displayed on the liquid crystal panel 11. When the luminance of pixels in an area is low, by reducing the luminance of LEDs 23 to 25 corresponded to the area, the power consumption of the backlight 13 can be reduced.

<2. Configuration of the Area Active Drive Processing Unit>

Figure 1:
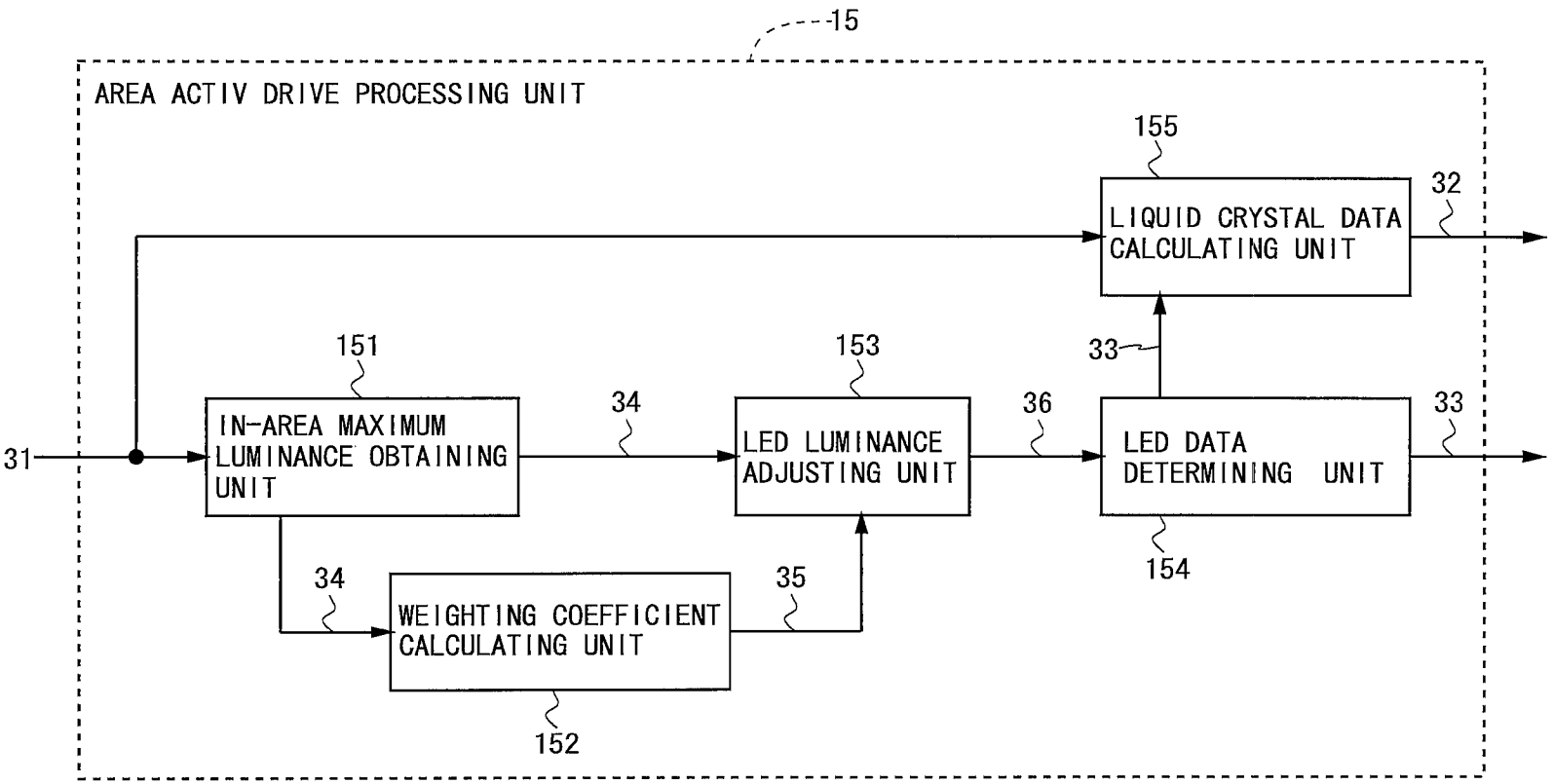
FIG. 1 is a block diagram showing a detailed configuration of an area active drive processing unit in an embodiment of the present invention.

FIG. 1 is a block diagram showing a detailed configuration of the area active drive processing unit 15 in the present embodiment. The area active drive processing unit 15 includes an in-area maximum luminance obtaining unit 151, a weighting coefficient calculating unit 152, an LED luminance adjusting unit 153, an LED data determining unit 154, and a liquid crystal data calculating unit 155. Note that in the present embodiment a light-emission luminance correcting unit is implemented by the LED luminance adjusting unit 153, and a display data calculating unit is implemented by the liquid crystal data calculating unit 155.

The in-area maximum luminance obtaining unit 151 divides an input image 31 into a plurality of areas and obtains, for each of the RGB colors, the highest value of the luminances of pixels in each area (hereinafter, referred to as the "maximum luminance value") 34 as a first light-emission luminance. The weighting coefficient calculating unit 152 obtains the maximum luminance values 34 for the respective RGB colors for all of the areas, and determines weighting coefficients 35 which are required upon an LED luminance adjustment process, as will be described later (this process is hereinafter referred to as a "weighting coefficient determination process"). The LED luminance adjusting unit 153 adjusts the luminances of respective RGB color LEDs in each area to suppress the occurrence of a color shift, based on the maximum luminance values 34 obtained by the in-area maximum luminance obtaining unit 151 and the weighting coefficients 35 determined by the weighting coefficient calculating unit 152.

The LED data determining unit 154 obtains LED data 33 for each of the RGB colors, taking into account the luminance balance between each area and its peripheral areas, the consistency with luminance in a preceding frame, etc., based on luminances 36 determined (adjusted) by the LED luminance adjusting unit 153. The liquid crystal data calculating unit 155 obtains liquid crystal data 32 representing the light transmittances of all of the display elements 21 included in the liquid crystal panel 11, based on the input image 31 and the LED data 33.

<3. Processing Procedure of the Area Active Drive Processing Unit>

Figure 4:
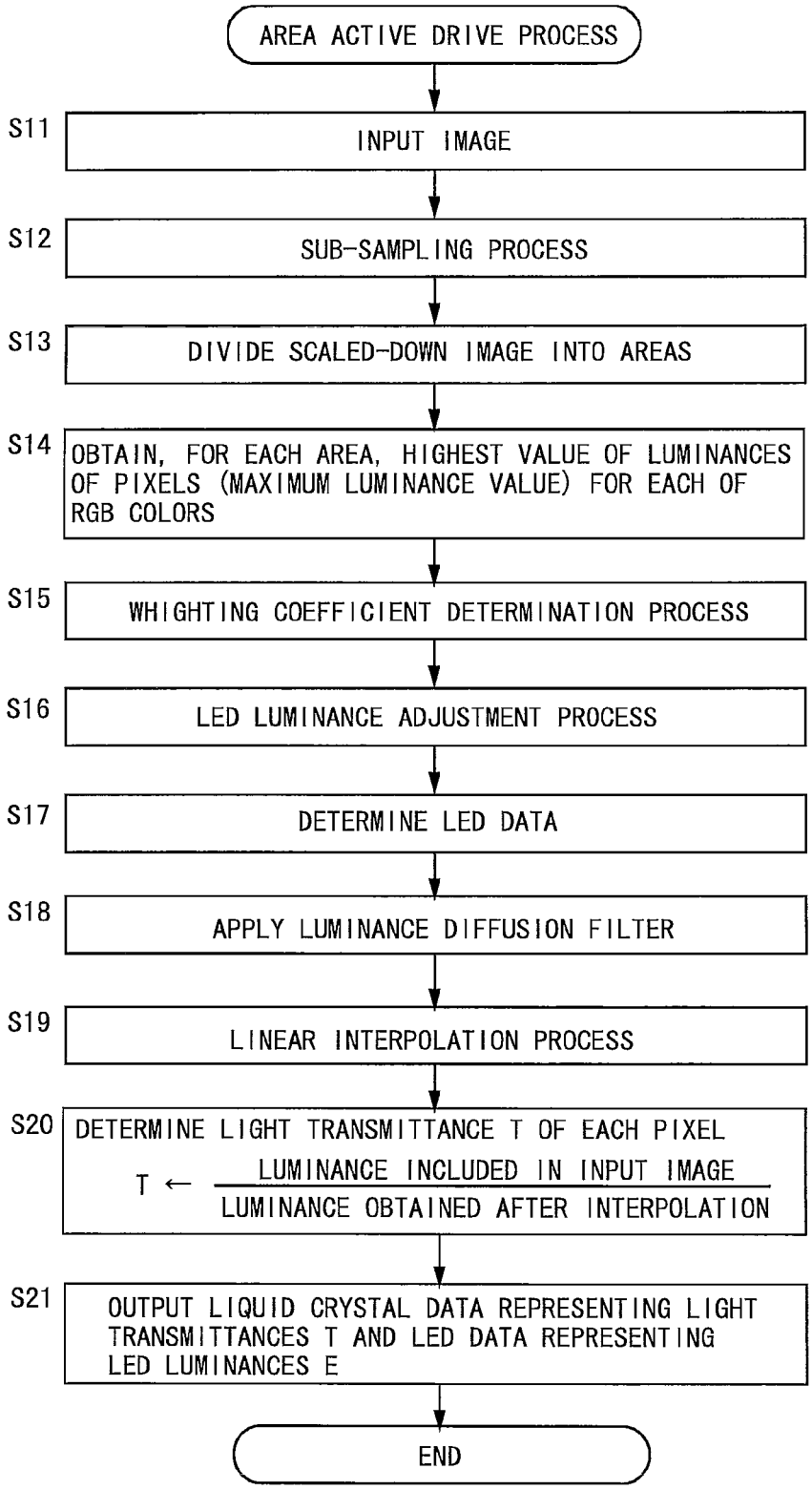
FIG. 4 is a flowchart showing a processing procedure of the area active drive processing unit in the embodiment.

FIG. 4 is a flowchart showing a processing procedure of the area active drive processing unit 15. An input image 31 of three RGB color components is inputted to the area active drive processing unit 15 (step S11). Each of the input images of the respective color components includes the luminances of (m×n) pixels.

Then, the area active drive processing unit 15 performs a sub-sampling process (averaging process) on each of the input images of the respective color components and thereby obtains a scaled-down image including the luminances of (sp×sq) pixels (s is an integer greater than or equal to 2) (step S12). At step S12, each of the input images of the respective color components is scaled down by a factor of (sp/m) in the horizontal direction and a factor of (sq/n) in the vertical direction. Then, the area active drive processing unit 15 divides the scaled-down image into (p×q) areas (step S13). Each area includes the luminances of (s×) pixels. Then, the area active drive processing unit 15 determines, for each of the (p×q) areas, the maximum luminance value for each of the RGB colors (step S14).

Then, the area active drive processing unit 15 performs a weighting coefficient determination process (step S15) and thereafter performs an LED luminance adjustment process (step S16). Note that a detailed description of the weighting coefficient determination process and the LED luminance adjustment process will be made later. Then, the area active drive processing unit 15 determines LED data 33 for each of the RGB colors, taking into account the luminance balance between each area and its peripheral areas, the consistency with luminance in a preceding frame, etc., based on luminances determined by the LED luminance adjustment process (step S17).

By the process in step S17, the LED data 33 representing (p×q) LED luminances for each color is outputted.

Then, the area active drive processing unit 15 applies, for each color, a luminance diffusion filter (dot diffusion filter) to the (p×q) LED luminances determined in step S17 and thereby obtains first backlight luminance data including (tp×tq) luminances (t is an integer greater than or equal to 2) (step S18). At step S18, the (p×q) LED luminances for each color are scaled up by a factor of t in both the horizontal direction and the vertical direction.

Then, the area active drive processing unit 15 performs a linear interpolation process on the first backlight luminance data and thereby obtains second backlight luminance data including (m×n) luminances for each color (step S19). At step S19, the first backlight luminance data is scaled up by a factor of (m/tp) in the horizontal direction and a factor of (n/tq) in the vertical direction. The second backlight luminance data represents the luminances of backlight lights of each color component that enter (m×n) display elements 21 of the color component when (p×q) LEDs of the color component emit lights at the luminances determined in step S17.

Then, the area active drive processing unit 15 divides the luminances of the (m×n) pixels included in each of the input images of the respective color components by the (m×n) luminances included in the second backlight luminance data, respectively, and thereby determines light transmittances T of the (m×n) display elements 21 of the color component (step S20).

Finally, the area active drive processing unit 15 outputs, for each color component, liquid crystal data 32 representing the (m×n) light transmittances which are determined in step S20 and the LED data 33 representing the (p×q) LED luminances which are determined in step S17 (step S21). At this time, the liquid crystal data 32 and the LED data 33 are converted into values in a suitable range, in accordance with the specifications of the panel drive circuit 12 and the backlight drive circuit 14.

The area active drive processing unit 15 performs the process shown in FIG. 4 on an R image, a G image, and a B image and thereby obtains, based on an input image 31 including the luminances of (m×n×3) pixels, liquid crystal data 32 representing (m×n×3) light transmittances and LED data 33 representing (p×q×3) LED luminances.

Figure 5:
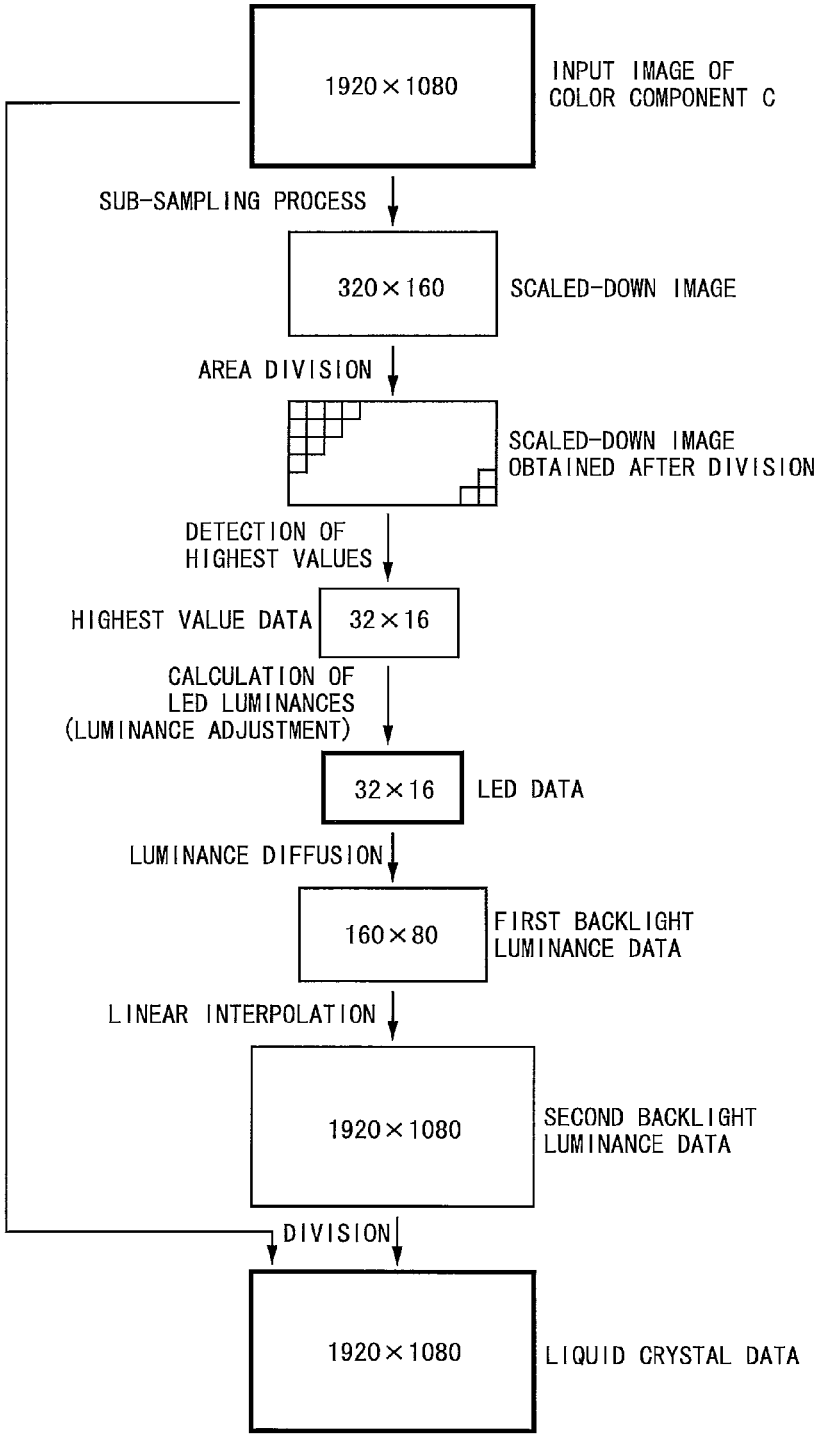
FIG. 5 is a diagram showing the process of obtaining liquid crystal data and LED data in the embodiment.

FIG. 5 is a diagram showing the process of obtaining liquid crystal data 32 and LED data 33 for the case in which m=1920, n=1080, p=32, q=16, s=10 and t=5. As shown in FIG. 5, by performing a sub-sampling process on an input image of a color component C which includes the luminances of (1920×1080) pixels, a scaled-down image including the luminances of (320×160) pixels is obtained. The scaled-down image is divided into (32×16) areas (the area size is (10×10) pixels). By determining the highest value of the luminances of pixels for each of the RGB colors in each area, (32×16) highest value data units are obtained for each color. Then, based on the highest value data, LED data representing (32×

16) LED luminances is obtained for each color. At that time, luminance adjustment is made to suppress the occurrence of a color shift.

By applying a luminance diffusion filter to the LED data for each color component, first backlight luminance data including (160×80) luminances is obtained for each color. Furthermore, by performing a linear interpolation process on the first backlight luminance data, second backlight luminance data including (1920×1080) luminances is obtained for each color. Finally, by dividing the luminances of the pixels included in the input image by the luminances included in the second backlight luminance data, liquid crystal data 32 including (1920×1080) light transmittances is obtained for each color.

Note that although in FIG. 5 the area active drive processing unit 15 performs a sub-sampling process on an input image to remove noise and performs area active drive based on a scaled-down image, the area active drive processing unit 15 may perform area active drive based on an original input image.

<4. Adjustment to LED Luminances>

In the present embodiment, to suppress the occurrence of a color shift while ensuring a sufficient color reproduction range, an adjustment is made to the luminances of RGB color LEDs in each area. The adjustment to the luminances of LEDs is made by a weighting coefficient determination process and an LED luminance adjustment process. Note that a signal value indicating the luminance of each LED to be determined by these processes is referred to as an "LED luminance signal value". The weighting coefficient determination process and the LED luminance adjustment process will be described below.

<4.1 Weighting Coefficient Determination Process>

Figure 6:
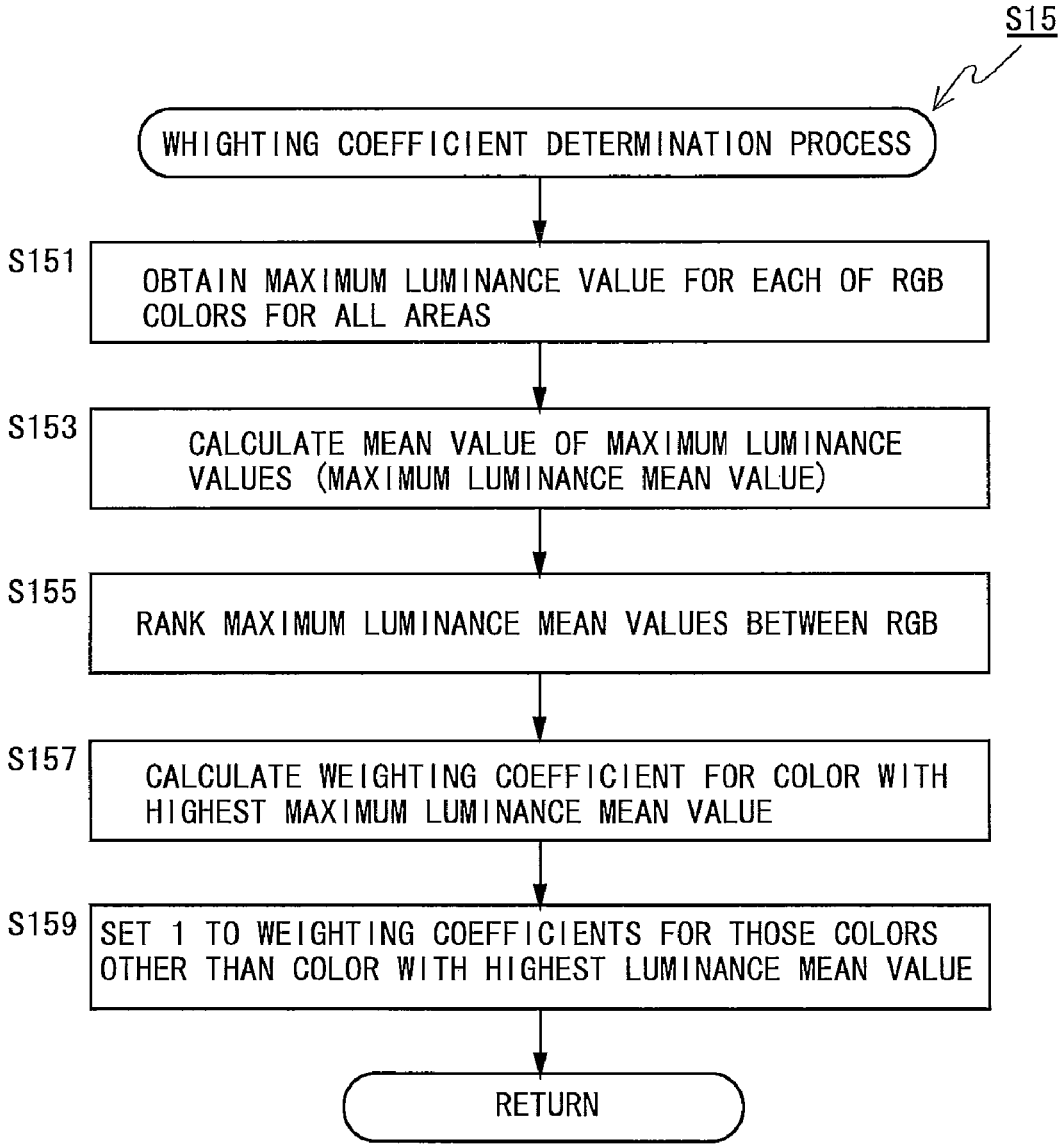
FIG. 6 is a flowchart showing a procedure for a weighting coefficient determination process in the embodiment.

FIG. 6 is a flowchart showing a procedure for a weighting coefficient determination process. The weighting coefficient calculating unit 152 in the area active drive processing unit 15 obtains the maximum luminance value (the highest value of the luminances of pixels in each area) for each of the RGB colors for all areas (step S151). Then, the weighting coefficient calculating unit 152 determines, for each of the RGB colors, a mean value of the maximum luminance values for all areas which are obtained in step S151 (hereinafter, referred to as a "maximum luminance mean value") (step S153). For example, when the liquid crystal panel includes (32×16) LED units 22, a maximum luminance mean value MEAN_R for the color R is determined by the following equation (1):

$$\text{MEAN_}R=\text{SUM_}R/(32\times16) \quad (1)$$

where SUM_R is the sum total of the maximum luminance values for the color R for all areas. Likewise, a maximum luminance mean value MEAN_G for the color G and a maximum luminance mean value MEAN_B for the color B are also determined.

Figure 20:
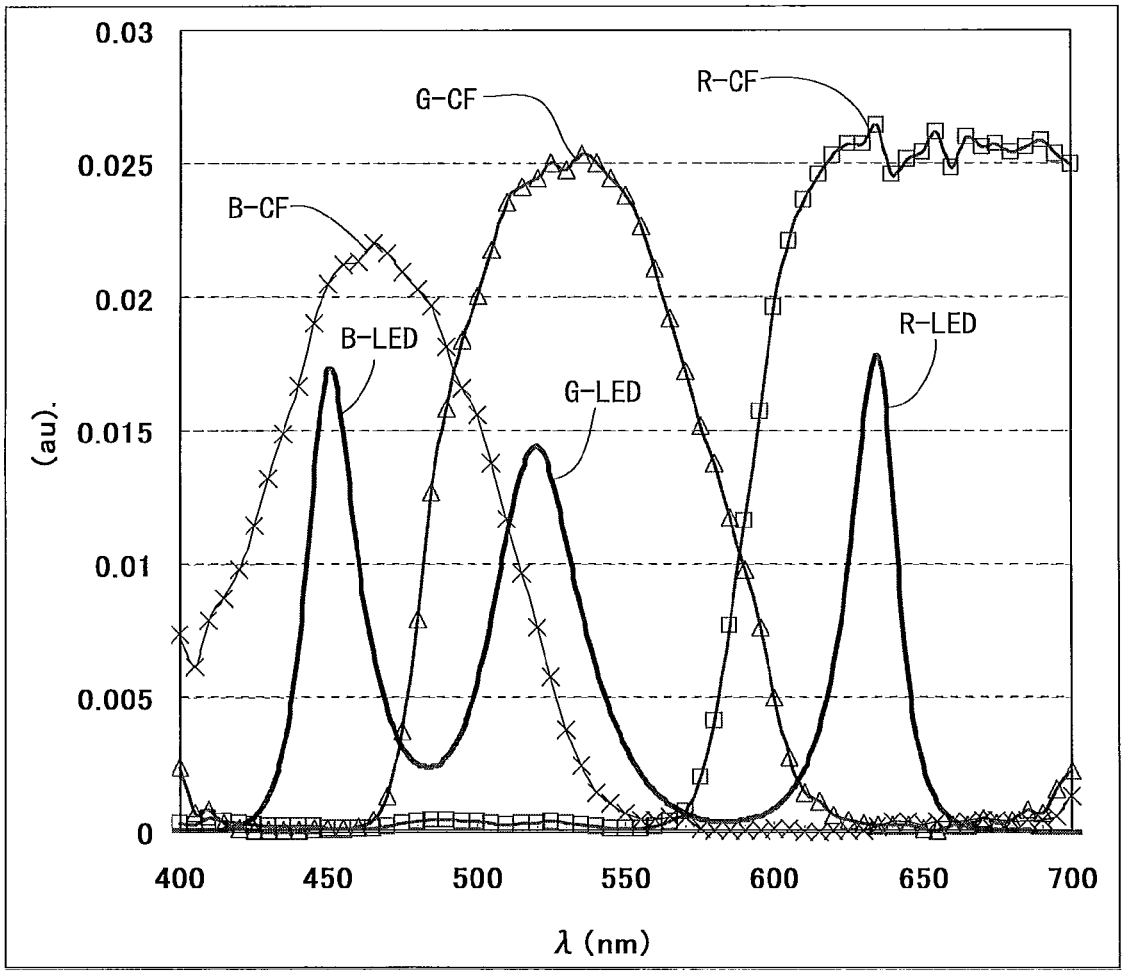
FIG. 20 is a diagram showing a relationship between the light transmission characteristics of RGB color filters and the wavelength of light emitted from LEDs.
Figure 21:
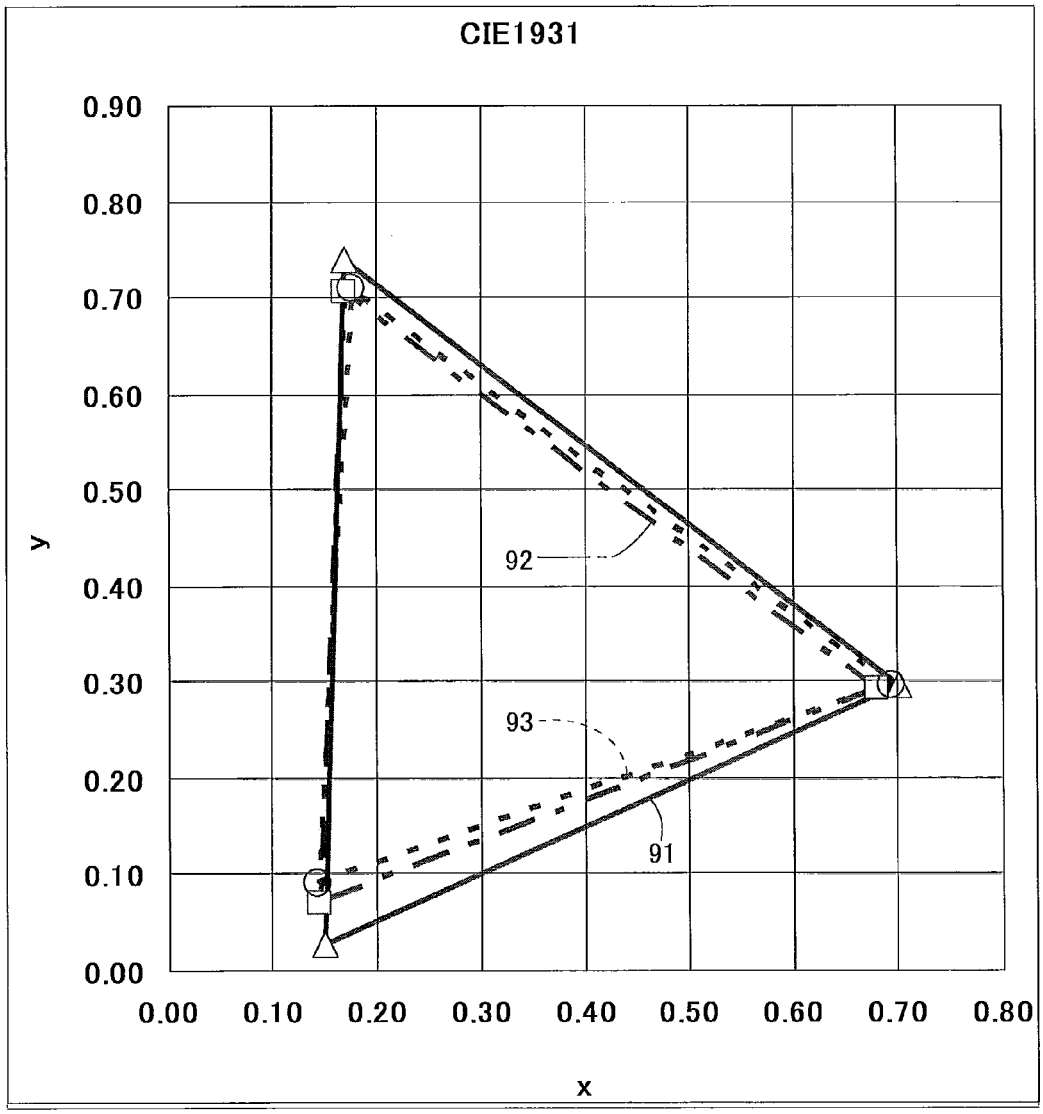
FIG. 21 is a diagram for describing color reproduction ranges obtained by different drive methods.

Then, the weighting coefficient calculating unit 152 compares the maximum luminance mean values for the three RGB colors (MEAN_R, MEAN_G, and MEAN_B) and ranks the values from highest to lowest (step S155). At that time, if the values for a plurality of colors are equal, then ranking of the magnitude of the values is performed in the following priority rankings: "the color B; the color G; and the color R". For example, if MEAN_B and MEAN_G are equal and MEAN_B is greater than MEAN_R, then the ranking "1st: MEAN_B, 2nd: MEAN_G, and 3rd: MEAN_R" is performed. In the case of an image in which 70% of the entire image is yellow and the remaining portion is gray with a low gray level, since MEAN_R and MEAN_G are equal and MEAN_R is greater than MEAN_B, the ranking "1st: MEAN_G, 2nd: MEAN_R, and 3rd: MEAN_B" is performed. Note that the priority rankings: "the color B; the color G; and the color R" are determined taking into account the overlapping of the characteristics of RGB color filters (the overlapping of the wavelengths of lights transmitted through), the luminance magnitude relationship between the RGB colors, etc. (see FIG. 20).

Then, the weighting coefficient calculating unit 152 calculates a weighting coefficient which is used in an LED luminance adjustment process and which is to be multiplied to an LED luminance signal value for a color with the highest maximum luminance mean value among the three RGB colors (step S157). The weighting coefficient W is specifically calculated by the following equation (2):

$$W=I\times(\text{MEAN_2}/\text{MEAN_1})+m \quad (2)$$

where MEAN_1 is the maximum luminance mean value for a color that is determined as 1st in step S155, and MEAN_2 is the maximum luminance mean value for a color that is determined as 2nd in step S155. Also, I is the coefficient which is set externally and which can take any value, and m is the intercept which is set externally and which can take any value.

Meanwhile, two weighting coefficients which are to be multiplied to the LED luminance signal value are provided for each of the RGB colors. For example, taking a look at the color G, a weighting coefficient Wg_r for adjusting the luminance of an R color LED and a weighting coefficient Wg_b for adjusting the luminance of a B color LED are provided. Therefore, when the ranking "1st: MEAN_G, 2nd: MEAN_R, and 3rd: MEAN_B" is performed in step S155, two weighting coefficients are calculated by the following equations (3) and (4):

$$Wg_r=I\times(\text{MEAN_}R/\text{MEAN_}G)+m \quad (3)$$

$$Wg_b=I\times(\text{MEAN_}B/\text{MEAN_}G)+m \quad (4).$$

Likewise, if it is determined in step S155 that the "1st: MEAN_R", then at this step S157 a weighting coefficient Wr_g for adjusting the luminance of a G color LED and a weighting coefficient Wr_b for adjusting the luminance of a B color LED are calculated. Alternatively, if it is determined in step S155 that the "1st: MEAN_B", then at this step S157 a weighting coefficient Wb_r for adjusting the luminance of an R color LED and a weighting coefficient Wb_g for adjusting the luminance of a G color LED are calculated.

Then, the weighting coefficient calculating unit 152 sets "1" to the weighting coefficients for those colors other than the color with the highest maximum luminance mean value (step S159). For example, if it is determined in step S155 that the "1st: MEAN_G", then weighting coefficients (Wg_r and Wg_b) which are to be multiplied to the LED luminance signal value for the color G are calculated in step S157, as described above, and weighting coefficients (Wr_g and Wr_b) which are to be multiplied to the LED luminance signal value for the color R and weighting coefficients (Wb_r and Wb_g) which are to be multiplied to the LED luminance signal value for the color B are set to "1" in step S159. When step S159 is completed, the weighting coefficient determination process ends and processing proceeds to step S16 in FIG. 4.

Weighting coefficients determined in a weighting coefficient determination process in the above-described manner (which are to be multiplied to an LED luminance signal value for each of the RGB colors) are used to adjust the luminances of the RGB color LEDs in an LED luminance adjustment process.

<4.2 LED Luminance Adjustment Process>

Figure 7:
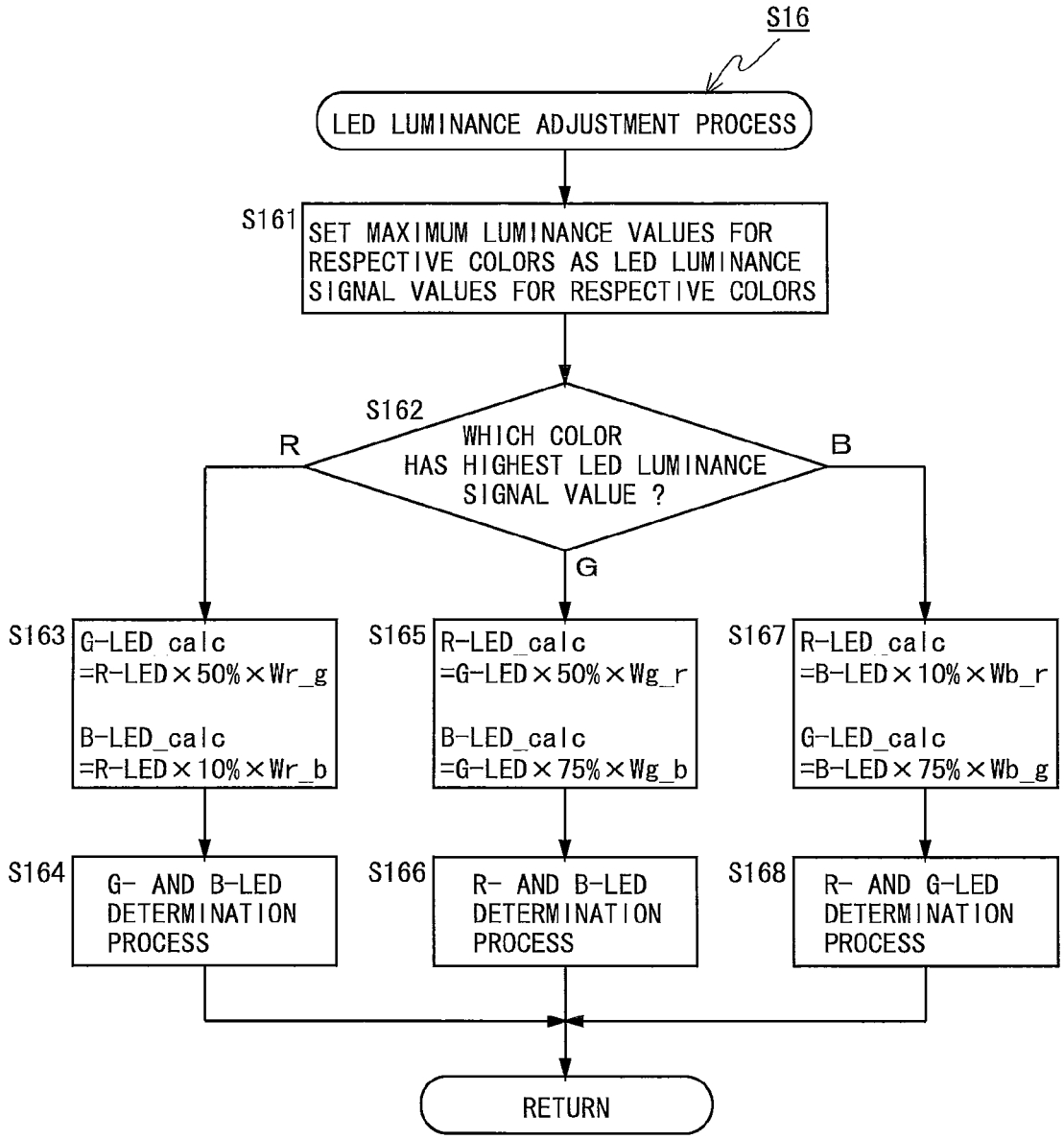
FIG. 7 is a flowchart showing a procedure for an LED luminance adjustment process in the embodiment.

FIG. 7 is a flowchart showing a procedure for an LED luminance adjustment process. Note that FIG. 7 shows a procedure for processes for one area, and the processes are performed on all areas. The LED luminance adjusting unit 153 in the area active drive processing unit 15 sets the maximum luminance values (the highest values of the luminances of pixels) for the respective RGB colors in an area (to be processed), as LED luminance signal values for the respective RGB colors in the area (step S161).

Then, the LED luminance adjusting unit 153 determines the color (reference color) that has the highest LED luminance signal value among the three RGB colors (step S162). Note that, as with step S155 in the aforementioned weighting coefficient determination process (see FIG. 6), if the values for a plurality of colors are equal, then the highest value is determined in the following priority rankings: "the color B; the color G; and the color R". If it is determined as a result of the determination in step S162 that the "LED luminance signal value for the color R is highest", then processing proceeds to step S163. If it is determined that the "LED luminance signal value for the color G is highest", then processing proceeds to step S165. If it is determined that the "LED luminance signal value for the color B is highest", then processing proceeds to step S167. Meanwhile, according to the result of the determination in step S162, a process is performed in steps after step S162, in which, with reference to the LED luminance signal value for a color with the highest LED luminance signal value among the RGB colors, the LED luminance signal values for other colors are adjusted. For example, if it is determined in step S162 that the "LED luminance signal value for the color R is highest", then a process of adjusting the LED luminance signal values for the colors G and B with reference to the LED luminance signal value for the color R is performed in steps S163 and S164.

At step S163, the LED luminance adjusting unit 153 sets values obtained by assigning predetermined weights to the LED luminance signal value for the color R, as a "weighted LED luminance signal value for the color G" (G-LED_calc) and a "weighted LED luminance signal value for the color B" (B-LED_calc). Then, the LED luminance adjusting unit 153 performs a "G- and B-LED determination process" for determining an LED luminance signal value for the color G and an LED luminance signal value for the color B (step S164).

Figure 8:
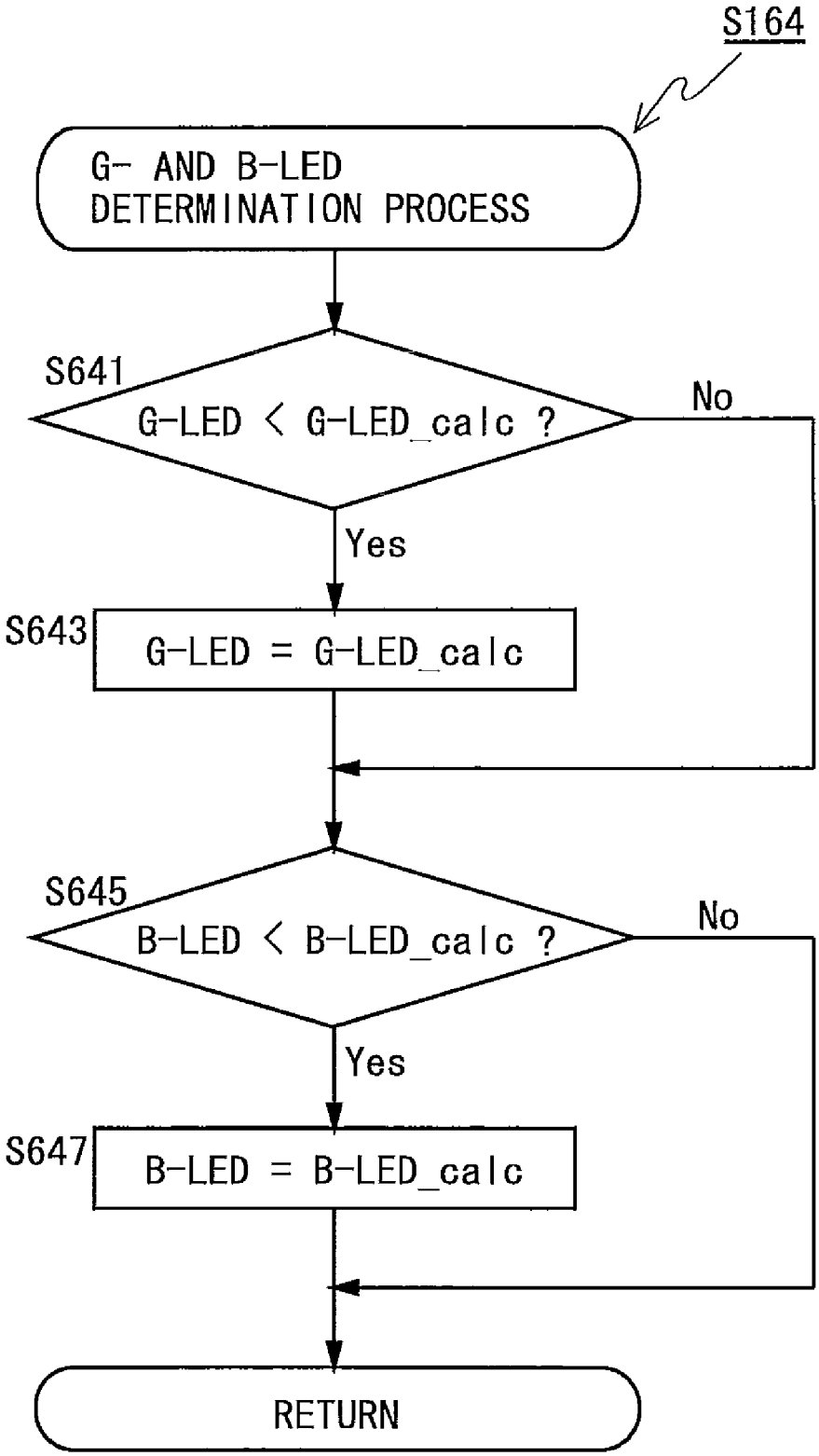
FIG. 8 is a flowchart showing a procedure for a "G- and B-LED determination process" in the embodiment.

FIG. 8 is a flowchart showing a procedure for the "G- and B-LED determination process". At step S641, the LED luminance adjusting unit 153 determines whether the "LED luminance signal value for the color G" (G-LED) is lower than the "weighted LED luminance signal value for the color G" (G-LED_calc). If, as a result of the determination, the "LED luminance signal value for the color G" is lower than the "weighted LED luminance signal value for the color G", then processing proceeds to step S643, or otherwise proceeds to step S645. At step S643, the LED luminance adjusting unit 153 sets the "weighted LED luminance signal value for the color G" as an "LED luminance signal value for the color G". After the completion of step S643, processing proceeds to step S645.

At step S645, the LED luminance adjusting unit 153 determines whether the "LED luminance signal value for the color B" (B-LED) is lower than the "weighted LED luminance signal value for the color B" (B-LED_calc). If, as a result of the determination, the "LED luminance signal value for the color B" is lower than the "weighted LED luminance signal value for the color B", then processing proceeds to step S647, or otherwise the "G- and B-LED determination process" ends. At step S647, the LED luminance adjusting unit 153 sets the "weighted LED luminance signal value for the color B" as an "LED luminance signal value for the color B". When step S647 is completed, the "G- and B-LED determination process" ends. Note that, when the "G- and B-LED determination process" ends, the LED luminance adjustment process ends and processing proceeds to step S17 in FIG. 4.

At step S165 in FIG. 7, the LED luminance adjusting unit 153 sets values obtained by assigning predetermined weights to the LED luminance signal value for the color G, as a "weighted LED luminance signal value for the color R" (R-LED_calc) and a "weighted LED luminance signal value for the color B" (B-LED_calc). Then, the LED luminance adjusting unit 153 performs an "R- and B-LED determination process" for determining an LED luminance signal value for the color R and an LED luminance signal value for the color B (step S166).

Figure 9:
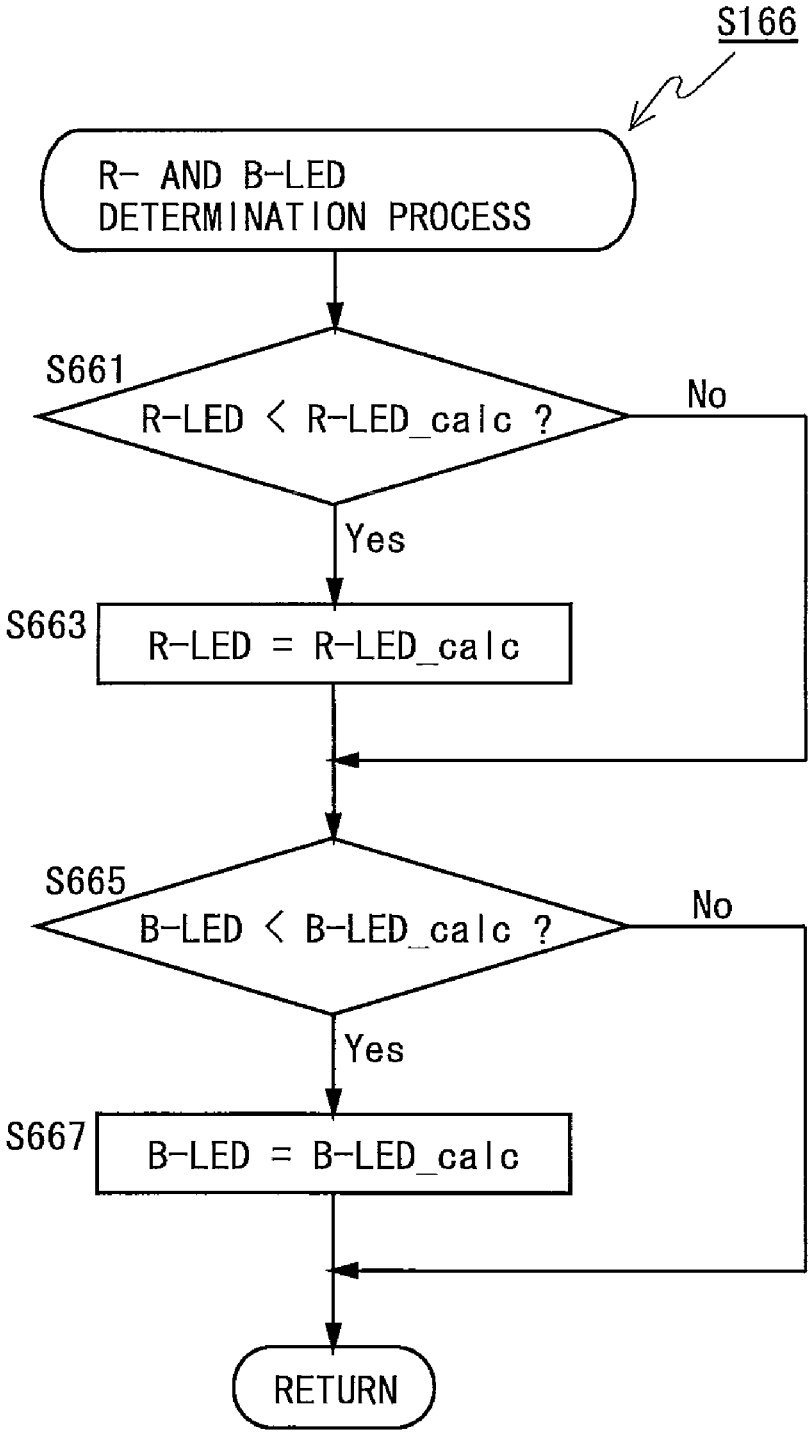
FIG. 9 is a flowchart showing a procedure for an "R- and B-LED determination process" in the embodiment.

FIG. 9 is a flowchart showing a procedure for the "R- and B-LED determination process". At step S661, the LED luminance adjusting unit 153 determines whether the "LED luminance signal value for the color R" (R-LED) is lower than the "weighted LED luminance signal value for the color R" (R-LED_calc). If, as a result of the determination, the "LED luminance signal value for the color R" is lower than the "weighted LED luminance signal value for the color R", then processing proceeds to step S663, or otherwise proceeds to step S665. At step S663, the LED luminance adjusting unit 153 sets the "weighted LED luminance signal value for the color R" as an "LED luminance signal value for the color R". After the completion of step S663, processing proceeds to step S665.

At step S665, the LED luminance adjusting unit 153 determines whether the "LED luminance signal value for the color B" (B-LED) is lower than the "weighted LED luminance signal value for the color B" (B-LED_calc). If, as a result of the determination, the "LED luminance signal value for the color B" is lower than the "weighted LED luminance signal value for the color B", then processing proceeds to step S667, or otherwise the "R- and B-LED determination process" ends. At step S667, the LED luminance adjusting unit 153 sets the "weighted LED luminance signal value for the color B" as an "LED luminance signal value for the color B". When step S667 is completed, the "R- and B-LED determination process" ends. Note that, when the "R- and B-LED determination process" ends, the LED luminance adjustment process ends and processing proceeds to step S17 in FIG. 4.

At step S167 in FIG. 7, the LED luminance adjusting unit 153 sets values obtained by assigning predetermined weights to the LED luminance signal value for the color B, as a "weighted LED luminance signal value for the color R" (R-LED_calc) and a "weighted LED luminance signal value for the color G" (G-LED_calc). Then, the LED luminance adjusting unit 153 performs an "R- and G-LED determination process" for determining an LED luminance signal value for the color R and an LED luminance signal value for the color G (step S168).

Figure 10:
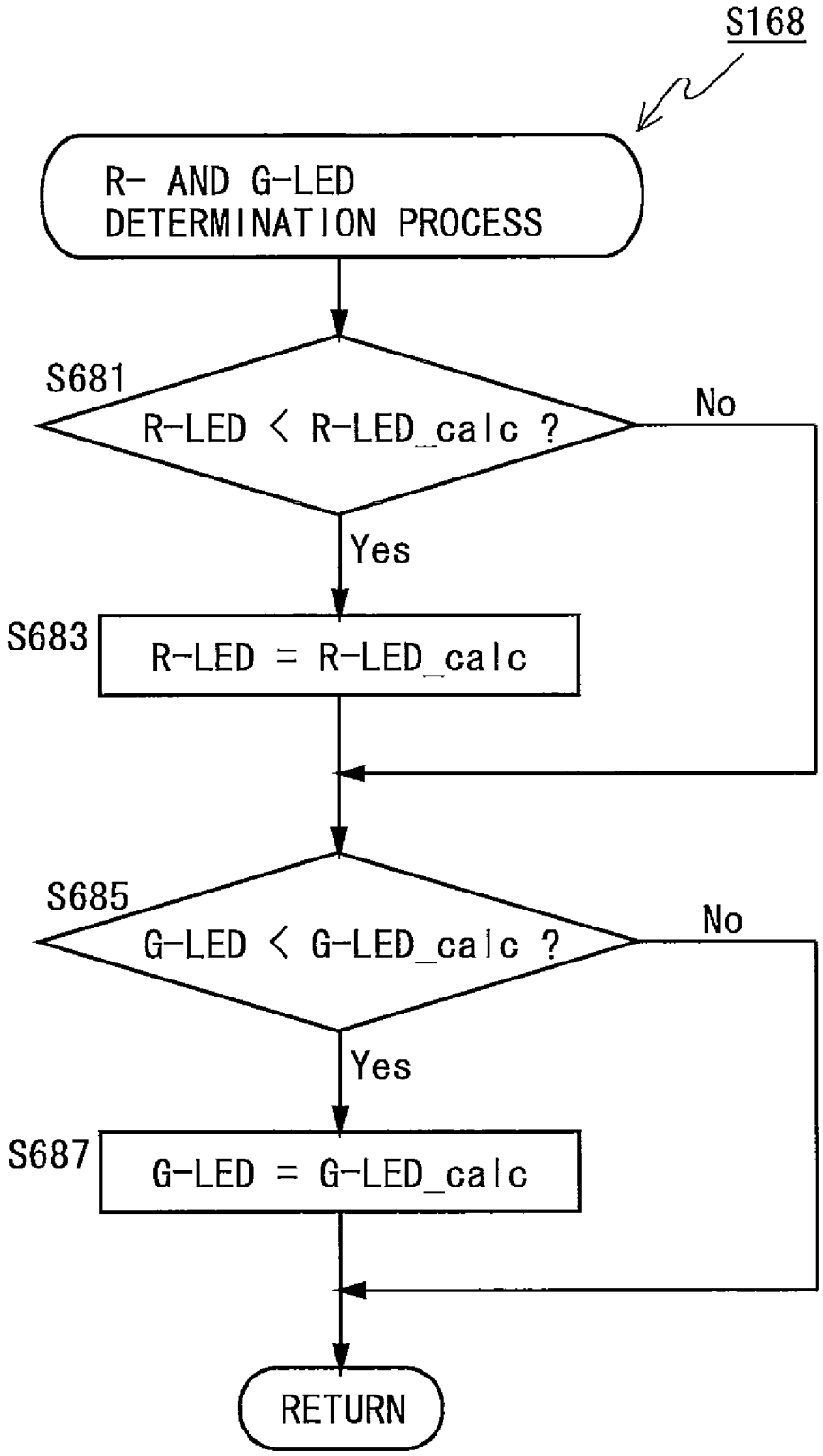
FIG. 10 is a flowchart showing a procedure for an "R- and G-LED determination process" in the embodiment.
Figure 11A:
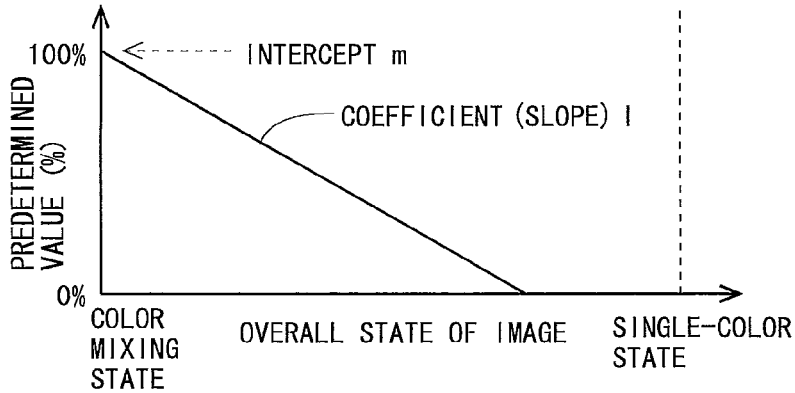
FIGS. 11A to 11D are diagrams for describing the setting of a coefficient and an intercept in the weighting coefficient determination process in the embodiment.
Figure 11B:
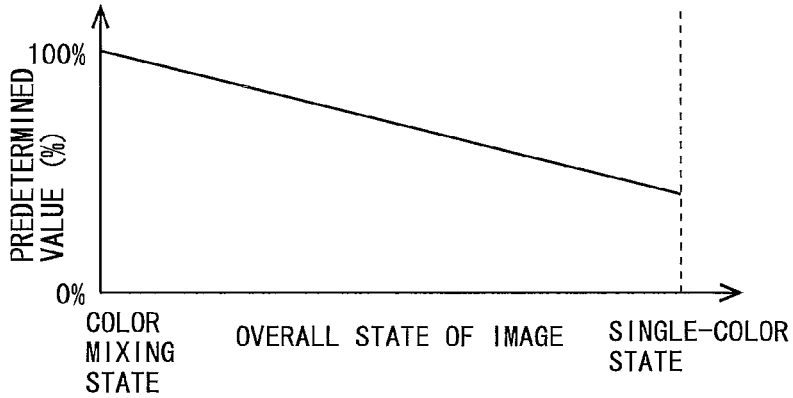
Figure 11C:
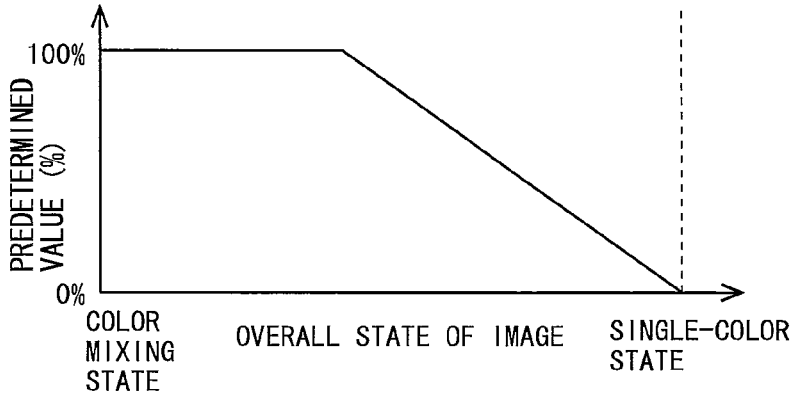
Figure 11D:
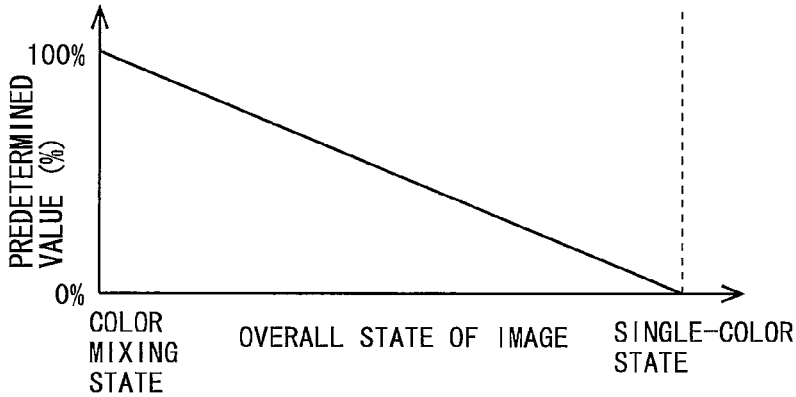

FIG. 10 is a flowchart showing a procedure for the "R- and G-LED determination process". At step S681, the LED luminance adjusting unit 153 determines whether the "LED luminance signal value for the color R" (R-LED) is lower than the "weighted LED luminance signal value for the color R" (R-LED_calc). If, as a result of the determination, the "LED luminance signal value for the color R" is lower than the "weighted LED luminance signal value for the color R", then processing proceeds to step S683, or otherwise proceeds to step S685. At step S683, the LED luminance adjusting unit 153 sets the "weighted LED luminance signal value for the color R" as an "LED luminance signal value for the color R". After the completion of step S683, processing proceeds to step S685.

At step S685, the LED luminance adjusting unit 153 determines whether the "LED luminance signal value for the color G" (G-LED) is lower than the "weighted LED luminance signal value for the color G" (G-LED_calc). If, as a result of the determination, the "LED luminance signal value for the color G" is lower than the "weighted LED luminance signal value for the color G", then processing proceeds to step S687, or otherwise the "R- and G-LED determination process" ends. At step S687, the LED luminance adjusting unit 153 sets the "weighted LED luminance signal value for the color G" as an "LED luminance signal value for the color G". When step S687 is completed, the "R- and G-LED determination process" ends. Note that, when the "R- and G-LED determination process" ends, the LED luminance adjustment process ends and processing proceeds to step S17 in FIG. 4.

Meanwhile, in steps S163, S165, and S167 in FIG. 7, to determine a weighted LED luminance signal value, the LED luminance signal value for a color with the highest LED luminance signal value among RGB is multiplied by a predetermined value (e.g., "50%" in the upper equation in step S163 ("0.5" as a value)) and the aforementioned weighting coefficient (e.g., Wr_g in the upper equation in step S163). The predetermined value (predetermined coefficient) is determined by a subjective evaluation and measurement, etc., based on the characteristics of RGB color filters and the characteristics of LEDs, to suppress the occurrence of a color shift. Thus, the predetermined value is not limited to those shown in FIG. 7. Also, for the weighting coefficient, in a weighting coefficient determination process, any value can be used for the coefficient I and the intercept m in the above-described equation (2). FIGS. 11A to 11D are diagrams conceptually showing the coefficient I and the intercept m in the above-described equation (2), to which various values are set. As such, since the coefficient I and the intercept m are arbitrary values, any appropriate value can be externally set to them to widen the color reproduction range. Note that in the present embodiment a correction luminance is implemented by a weighted LED luminance signal value for each color.

<5. Effects>

According to the present embodiment, in each area, the luminances of LEDs of those colors among RGB other than a color with the maximum luminance value are adjusted by an LED luminance adjustment process. At this time, for each of the colors other than the color with the maximum luminance value, if the luminance of the LED based on an input image is lower than a luminance obtained by assigning a predetermined weight to the luminance of the LED of the color with the maximum luminance value, then the luminance of the LED of the color is increased. As a result, a color shift is less likely to be visually recognized, which will be described with reference to FIGS. 12A and 12B.

Figure 12A:
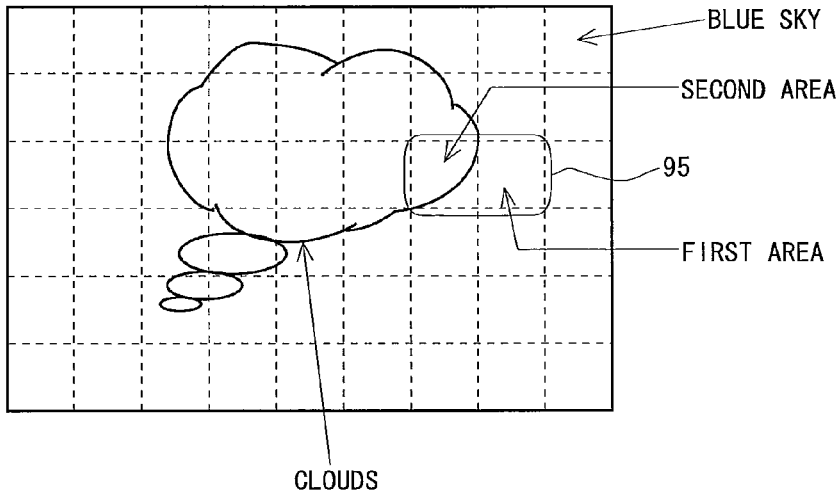
FIGS. 12A and 12B are diagrams for describing an effect obtained in the embodiment.
Figure 12B:
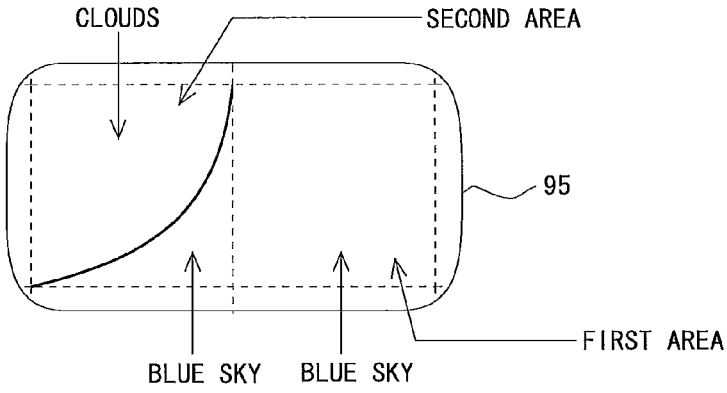

FIG. 12A schematically shows an image where "clouds are floating in the blue sky". FIG. 12B is an enlarged view of a region indicated by reference numeral 95 in FIG. 12A. Here, the right half region of the region indicated by reference numeral 95 is referred to as the "first area" and the left half region is referred to as the "second area". In a conventional display device, when such an image is displayed, the lighting states of the respective RGB color LEDs are as follows. Since only the "blue sky" is included in the first area, only a B color LED lights in the first area. On the other hand, a "cloud" and the "blue sky" are included in the second area, and a relatively large region is occupied by the "cloud". Hence, in the second area, LEDs of three RGB colors light to perform white display. Here, in the "blue sky" region in the second area, since the LEDs of the three RGB colors in the area light, "spectral wavelength leakage" occurs. Due to this, the color of the "blue sky" region in the second area differs from the color in the first area. As a result, a color shift is visually recognized. On the other hand, according to the present embodiment, in the above-described first area, in addition to a B color LED lights, G and R color LEDs also light slightly. Hence, the color of the "blue sky" region in the second area is relatively close to the color of the "blue sky" region in the first area, suppressing the occurrence of a color shift.

Figure 13:
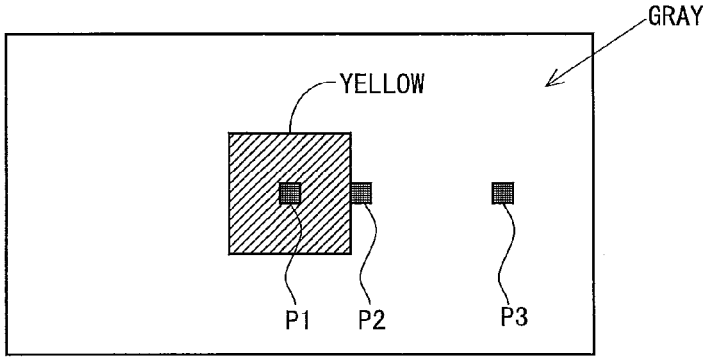
FIG. 13 is a diagram for describing an effect obtained in the embodiment.
Figure 14:
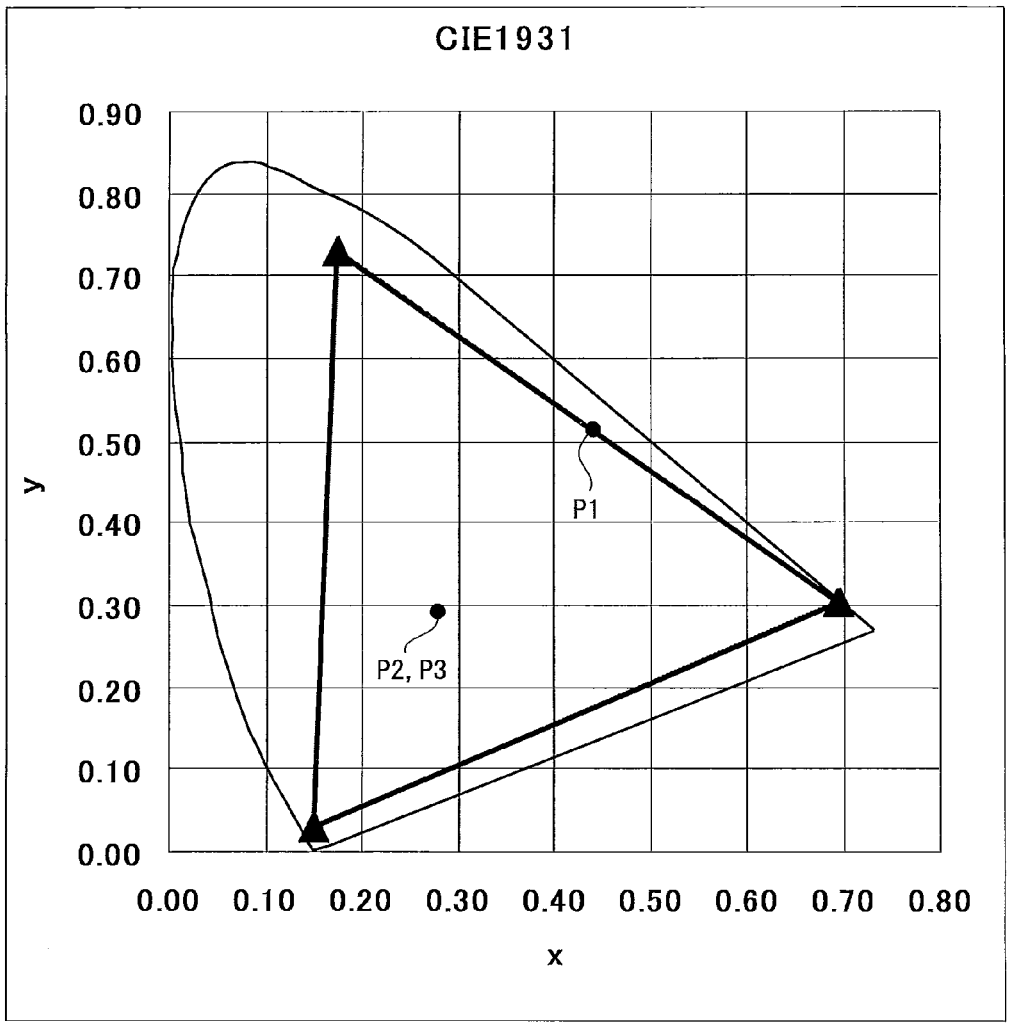
FIG. 14 is an xy chromaticity diagram for describing the effect obtained in the embodiment.
Figure 18A:
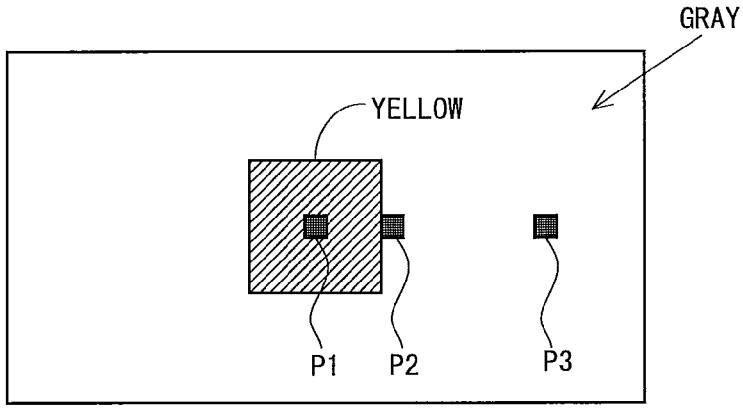
FIGS. 18A and 18B are diagrams for describing a color shift.
Figure 18B:
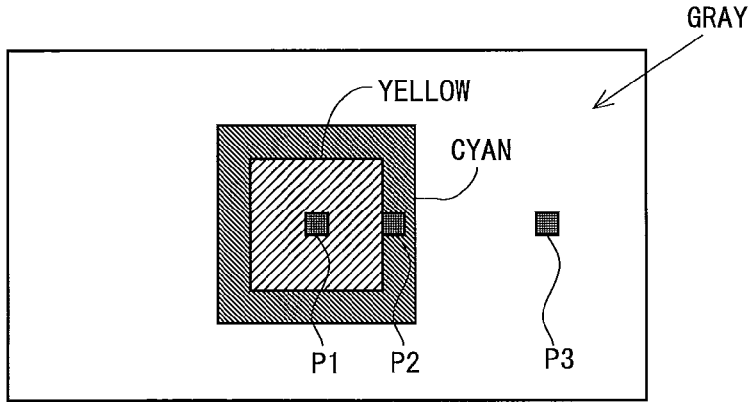
Figure 19:
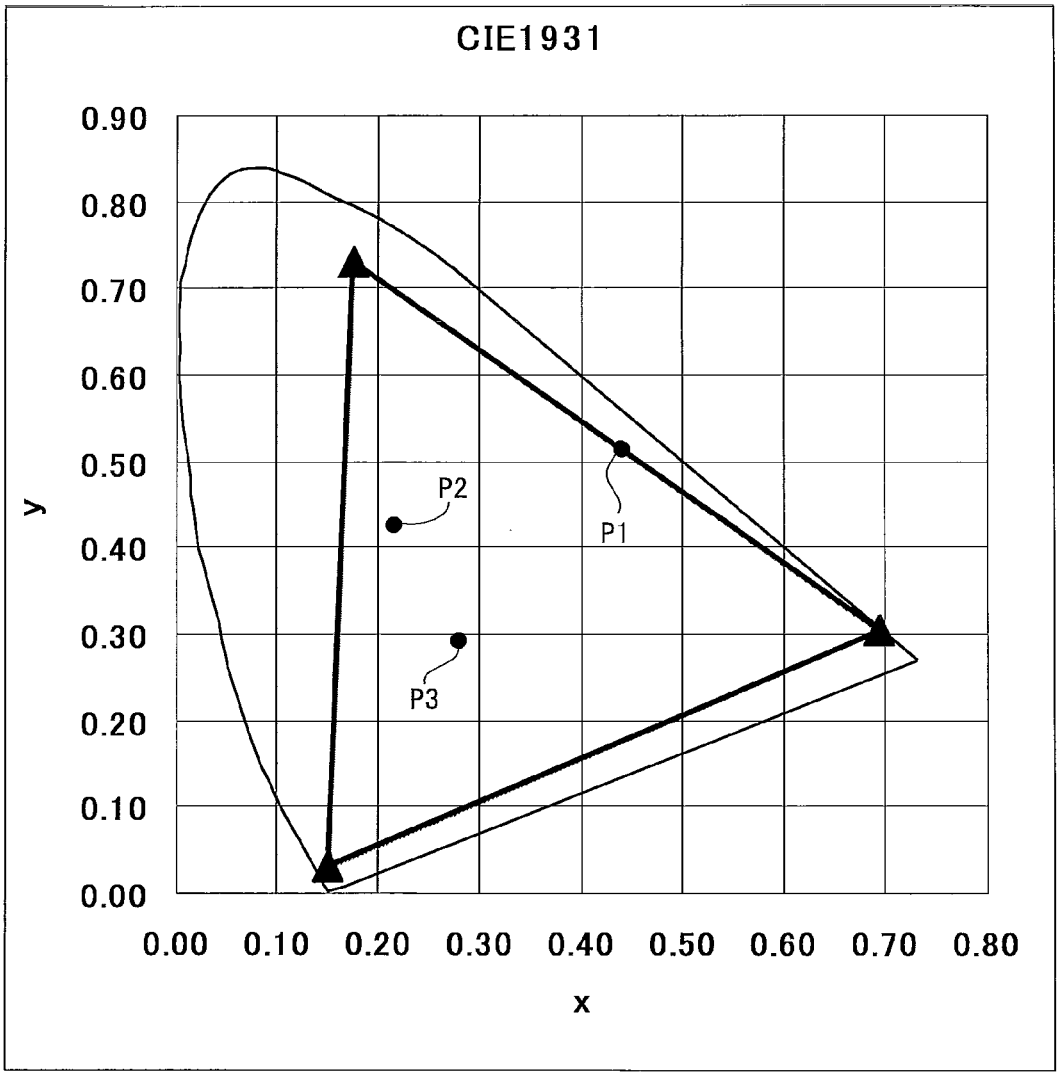
FIG. 19 is an xy chromaticity diagram for describing a color shift.

In addition, according to the present embodiment, weighting coefficients for adjusting the luminances of the respective RGB color LEDs are dynamically changed according to an input image 31. Hence, (luminance) adjustment according to the input image 31 is made to the light-emission luminances of the respective RGB color LEDs. As described above, since an equation for determining a weighting coefficient includes the coefficient I and the intercept m to which any value can be set, by setting suitable values to the values of the coefficient I and the intercept m, for example, a portion with the highest color signal value can be displayed in vibrant color, according to the content of the input image 31. In this manner, a liquid crystal display device capable of suppressing the occurrence of a color shift while ensuring a sufficient color reproduction range is implemented. Accordingly, for example, when display of a square pattern of a single yellow color with the highest gray level is performed in the center of a gray background with 64 gray levels (when the input image 31 is an image shown in FIG. 18A), as shown in FIG. 13, such display is performed that a portion indicated by reference numeral P1 is yellow with the highest gray level and portions indicated by reference numerals P2 and P3 are gray. Note that at this time the portion indicated by reference numeral P2 and the portion indicated by reference numeral P3 have the same coordinates in an xy chromaticity diagram (see FIG. 14).

Furthermore, as described above, since the light-emission luminances of LEDs can be adjusted according to the input image 31, by suppressing light emission from LEDs as necessary, power consumption is reduced.

<6. Variant>

Figure 15:
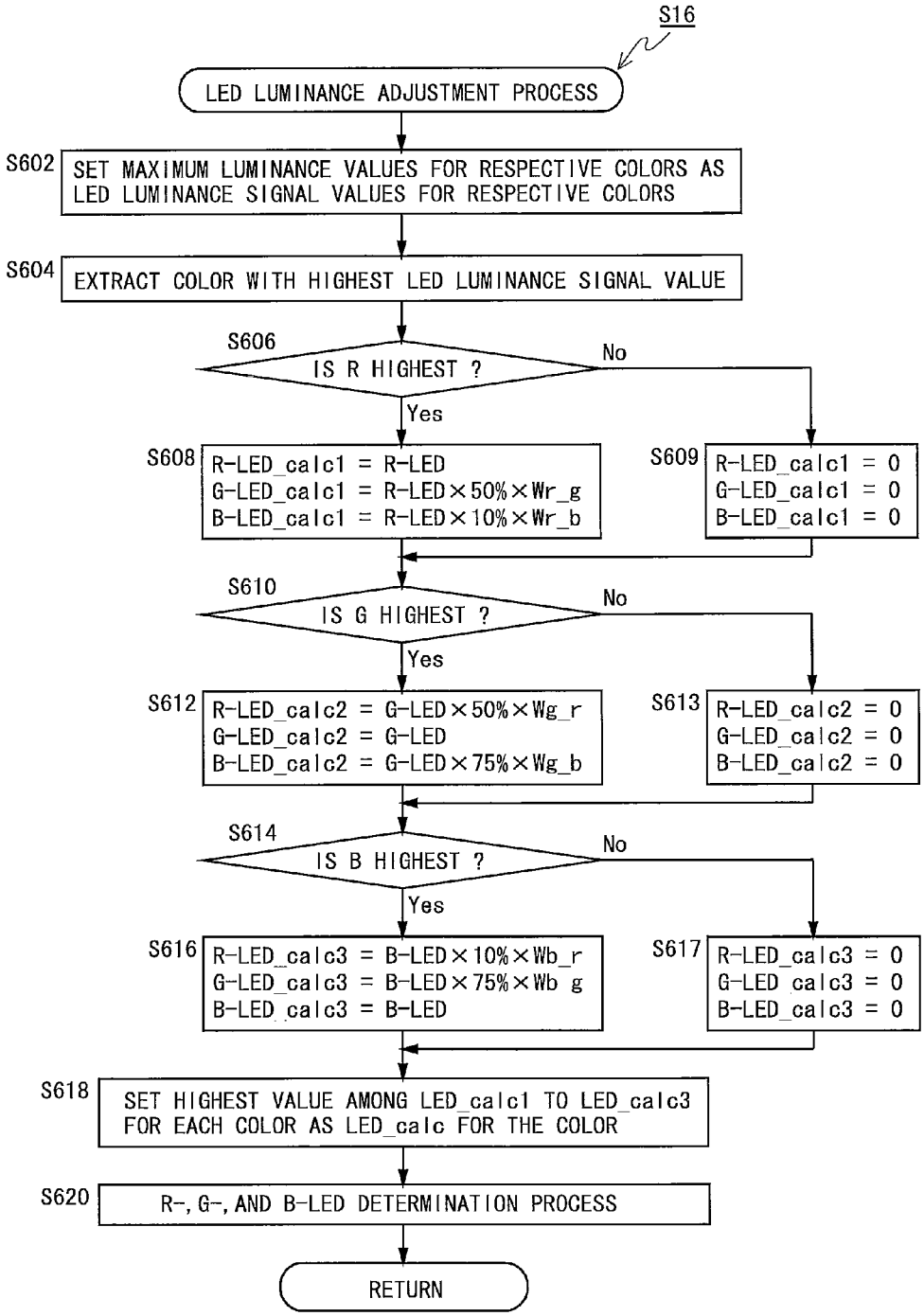
FIG. 15 is a flowchart showing a procedure for an LED luminance adjustment process in a variant of the embodiment.

Next, a variant of the above-described embodiment will be described. FIG. 15 is a flowchart showing a procedure for an LED luminance adjustment process in a variant of the above-described embodiment. First, the LED luminance adjusting unit 153 in the area active drive processing unit 15 sets the maximum luminance values (the highest values of the luminances of pixels) for the respective RGB colors in an area (to be processed), as LED luminance signal values for the respective RGB colors in the area (step S602). Then, the LED luminance adjusting unit 153 extracts a color with the highest value among the LED luminance signal values for the respective RGB colors (step S604). Here, unlike step S162 in the above-described embodiment (see FIG. 7), if the LED luminance signal values for a plurality of colors are identical and are highest, then all of the plurality of colors are extracted as the color with the highest value. For example, if the LED luminance signal value for the color R and the LED luminance signal value for the color B are equal and the LED luminance signal value for the color R is higher than the LED luminance signal value for the color G, then the colors R and B are extracted as the color with the highest LED luminance signal value.

Then, the LED luminance adjusting unit 153 determines whether the color R is a color with the highest LED luminance signal value (step S606). If, as a result of the determination, the color R is a color with the highest LED luminance signal value, then processing proceeds to step S608, or otherwise proceeds to step S609.

At step S608, the LED luminance adjusting unit 153 sets the LED luminance signal value (original value) for the color R as a "first weighted LED luminance signal value for the color R", and sets values obtained by assigning predetermined weights to the LED luminance signal value for the color R, as a "first weighted LED luminance signal value for the color G" and a "first weighted LED luminance signal value for the color B". Thereafter, processing proceeds to step S610.

At step S609, the LED luminance adjusting unit 153 sets "0" to the "first weighted LED luminance signal value for the color R", the "first weighted LED luminance signal value for the color G", and the "first weighted LED luminance signal value for the color B". Thereafter, processing proceeds to step S610.

At step S610, the LED luminance adjusting unit 153 determines whether the color G is a color with the highest LED luminance signal value. If, as a result of the determination, the color G is a color with the highest LED luminance signal value, then processing proceeds to step S612, or otherwise proceeds to step S613.

At step S612, the LED luminance adjusting unit 153 sets the LED luminance signal value (original value) for the color G as a "second weighted LED luminance signal value for the color G", and sets values obtained by assigning predetermined weights to the LED luminance signal value for the color G, as a "second weighted LED luminance signal value for the color R" and a "second weighted LED luminance signal value for the color B". Thereafter, processing proceeds to step S614.

At step S613, the LED luminance adjusting unit 153 sets "0" to the "second weighted LED luminance signal value for the color R", the "second weighted LED luminance signal value for the color G", and the "second weighted LED luminance signal value for the color B". Thereafter, processing proceeds to step S614.

At step S614, the LED luminance adjusting unit 153 determines whether the color B is a color with the highest LED luminance signal value. If, as a result of the determination, the color B is a color with the highest LED luminance signal value, then processing proceeds to step S616, or otherwise proceeds to step S617.

At step S616, the LED luminance adjusting unit 153 sets the LED luminance signal value (original value) for the color B as a "third weighted LED luminance signal value for the color B", and sets values obtained by assigning predetermined weights to the LED luminance signal value for the color B, as a "third weighted LED luminance signal value for the color R" and a "third weighted LED luminance signal value for the color G". Thereafter, processing proceeds to step S618.

At step S617, the LED luminance adjusting unit 153 sets "0" to the "third weighted LED luminance signal value for the color R", the "third weighted LED luminance signal value for the color G", and the "third weighted LED luminance signal value for the color B". Thereafter, processing proceeds to step S618.

At step S618, the LED luminance adjusting unit 153 sets the highest value for each color among the first to third weighted LED luminance signal values for each of the RGB colors, as a weighted LED luminance signal value for the color. Then, the LED luminance adjusting unit 153 performs an "R-, G-, and B-LED determination process" for determining LED luminance signal values for the three RGB colors (step S620).

Figure 16:
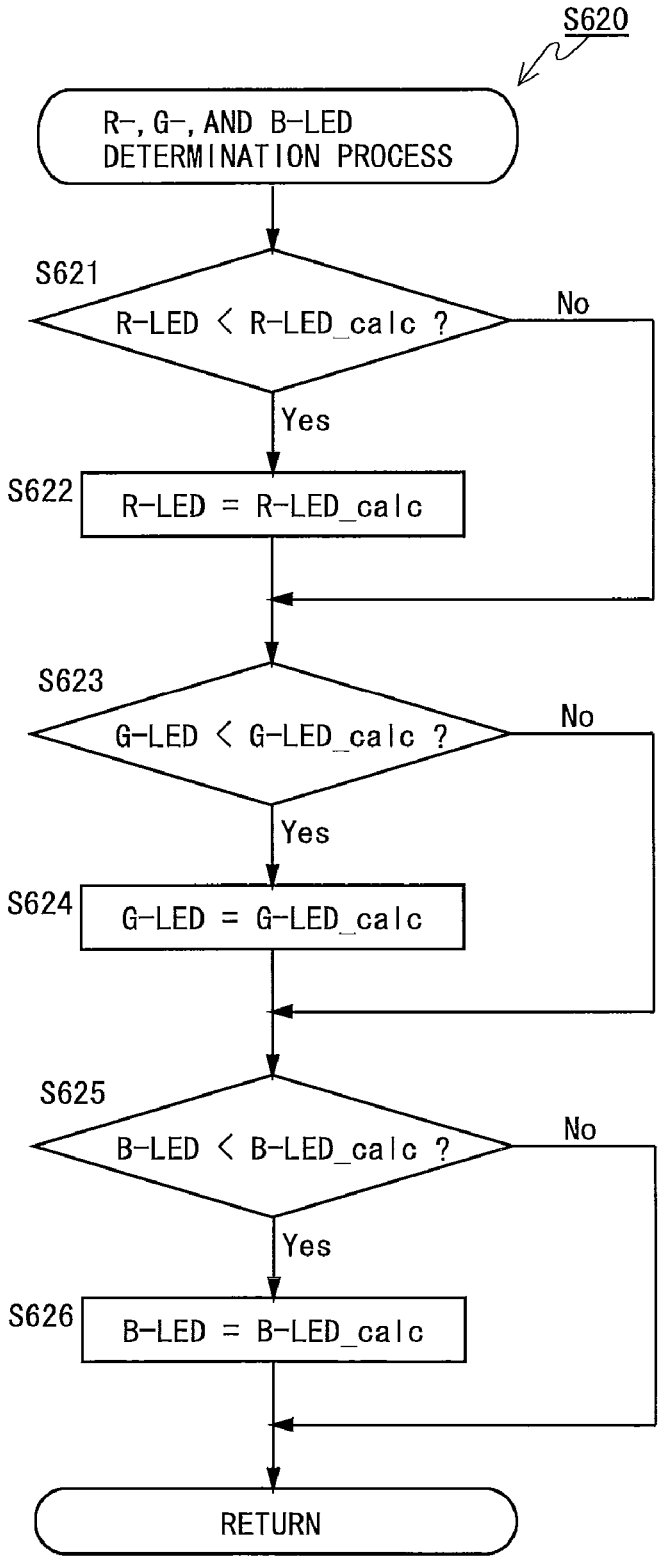
FIG. 16 is a flowchart showing a procedure for an "R-, G-, and B-LED determination process" in the variant of the embodiment.

FIG. 16 is a flowchart showing a procedure for the "R-, G-, and B-LED determination process". At step S621, the LED luminance adjusting unit 153 determines whether the "LED luminance signal value for the color R" is lower than the "weighted LED luminance signal value for the color R". If, as a result of the determination, the "LED luminance signal value for the color R" is lower than the "weighted LED luminance signal value for the color R", then processing proceeds to step S622, or otherwise proceeds to step S623. At step S622, the LED luminance adjusting unit 153 sets the "weighted LED luminance signal value for the color R" as an "LED luminance signal value for the color R". After the completion of step S622, processing proceeds to step S623.

At step S623, the LED luminance adjusting unit 153 determines whether the "LED luminance signal value for the color G" is lower than the "weighted LED luminance signal value for the color G". If, as a result of the determination, the "LED luminance signal value for the color G" is lower than the "weighted LED luminance signal value for the color G", then processing proceeds to step S624, or otherwise proceeds to step S625. At step S624, the LED luminance adjusting unit 153 sets the "weighted LED luminance signal value for the color G" as an "LED luminance signal value for the color G". After the completion of step S624, processing proceeds to step S625.

At step S625, the LED luminance adjusting unit 153 determines whether the "LED luminance signal value for the color B" is lower than the "weighted LED luminance signal value for the color B". If, as a result of the determination, the "LED luminance signal value for the color B" is lower than the "weighted LED luminance signal value for the color B", then processing proceeds to step S626, or otherwise the "R-, G-, and B-LED determination process" ends. At step S626, the LED luminance adjusting unit 153 sets the "weighted LED luminance signal value for the color B" as an "LED luminance signal value for the color B". When step S626 is completed, the "R-, G-, and B-LED determination process" ends. Note that, when the "R-, G-, and B-LED determination process" ends, the LED luminance adjustment process ends and, as in the above-described embodiment, processing proceeds to step S17 in FIG. 4.

Even by the present variant, as with the above-described embodiment, a liquid crystal display device capable of suppressing the occurrence of a color shift while ensuring a sufficient color reproduction range is implemented.

Figure 17:
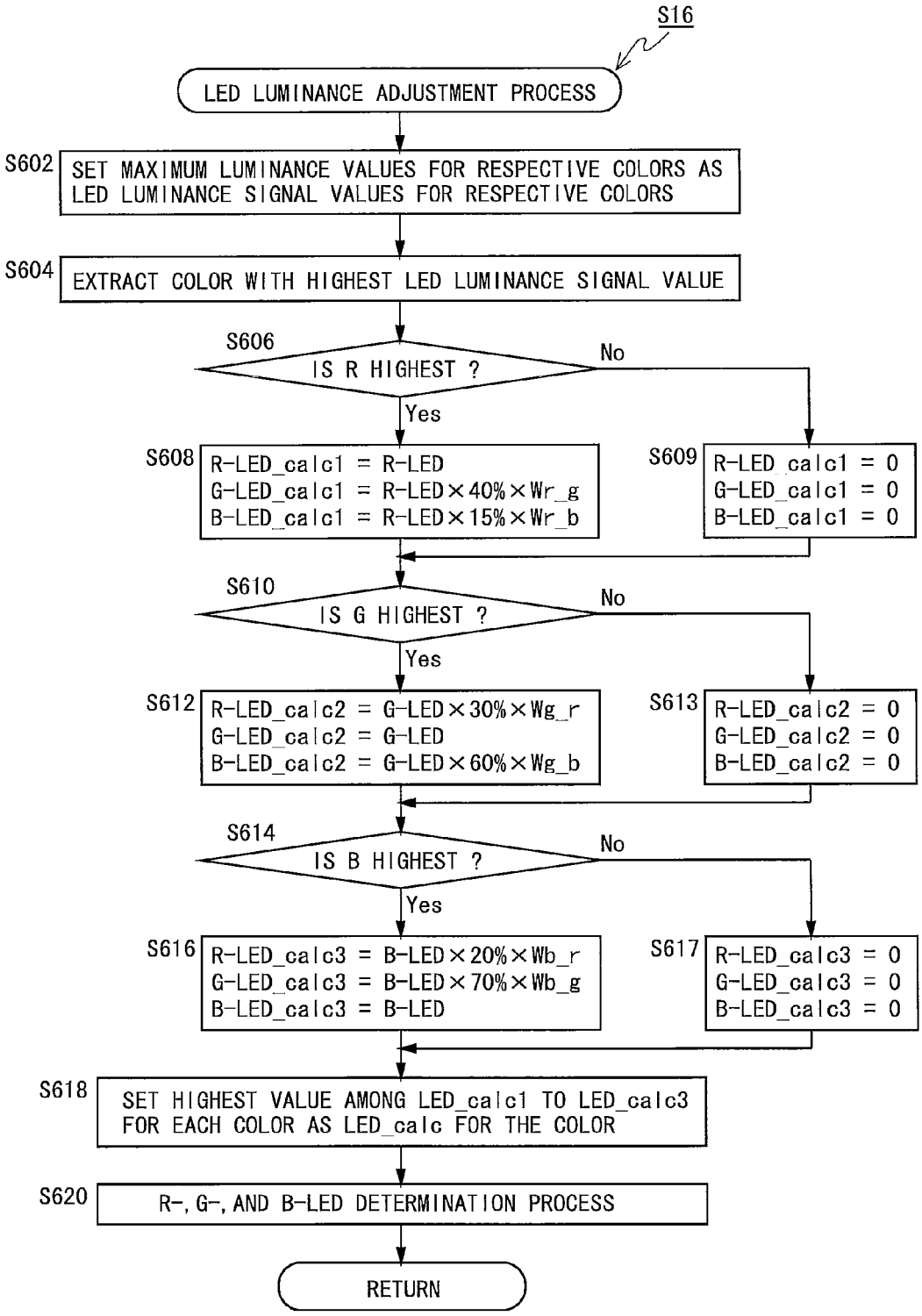
FIG. 17 is a flowchart showing another example of a procedure for an LED luminance adjustment process in the variant of the embodiment.

Note that predetermined values (e.g., "50%" in the second equation in step S608 in FIG. 15 ("0.5" as a value)) by which the LED luminance signal value for each color is multiplied to determine first to third weighted LED luminance signal values for the color, are determined by, as with the above-described embodiment, a subjective evaluation and measurement, etc., based on the characteristics of RGB color filters and the characteristics of LEDs, to suppress the occurrence of a color shift. Therefore, the predetermined values are not limited to those shown in FIG. 15, and the values shown in steps S608, S612, and S616 in FIG. 15 may be, for example, those values shown in FIG. 17.

Note also that in step S604 in FIG. 15 the extraction of a color with the highest value among LED luminance signal values for the respective RGB colors is performed, and when the highest and second highest values are close (e.g., when, in a display device with 256 gray levels, the highest value is "200" and the second highest value is "199"), those two colors having such values may be extracted as the "color with the highest value".

<7. Others>

Although in the above-described embodiment a weighting coefficient W is calculated by the aforementioned equation (2), the present invention is not limited thereto. For example, the weighting coefficient W may be calculated by the following equation (5):

$$W=I\times(\text{MEAN_3}/\text{MEAN_1})+m \quad (5)$$

where MEAN_1 is the maximum luminance mean value for a color that is determined as 1st in step S155, and MEAN_3 is the maximum luminance mean value for a color that is determined as 3rd in step S155. Also, I is the coefficient which is set externally and which can take any value, and m is the intercept which is set externally and which can take any value.

In addition, whether or not to perform "weighting" may be determined by whether it is a portion with a relatively large difference in LED luminance signal value between adjacent areas or it is a portion with a relatively small difference. Accordingly, a sudden change in color reproduction range between adjacent areas can be suppressed.

Furthermore, in the above-described embodiment, since a weighting coefficient is expressed by a primary expression, fluctuations in value determined as the weighting coefficient are linear. However, the present invention is not limited thereto and, for example, a weighting coefficient may be expressed by a quadratic expression and fluctuations in value determined as the weighting coefficient may be curved.

DESCRIPTION OF THE REFERENCE NUMERALS

10: LIQUID CRYSTAL DISPLAY DEVICE
11: LIQUID CRYSTAL PANEL
12: PANEL DRIVE CIRCUIT
13: BACKLIGHT
14: BACKLIGHT DRIVE CIRCUIT
15: AREA ACTIVE DRIVE PROCESSING UNIT
21: DISPLAY ELEMENT
22: LED UNIT
23: RED LED
24: GREEN LED
25: BLUE LED
31: INPUT IMAGE
32: LIQUID CRYSTAL DATA
33: LED DATA
34: MAXIMUM LUMINANCE VALUE FOR EACH OF RGB COLORS IN EACH AREA
35: WEIGHTING COEFFICIENT
36: LUMINANCE OBTAINED AFTER LED LUMINANCE ADJUSTMENT PROCESS
151: IN-AREA MAXIMUM LUMINANCE OBTAINING UNIT
152: WEIGHTING COEFFICIENT CALCULATING UNIT
153: LED LUMINANCE ADJUSTING UNIT
154: LED DATA DETERMINING UNIT
155: LIQUID CRYSTAL DATA CALCULATING UNIT

The invention claimed is:

1. An image display device having a function of controlling a luminance of a backlight, the image display device comprising:

a display panel including a plurality of display elements;

a backlight including a plurality of light sources of three RGB colors;

an in-area maximum luminance obtaining unit that divides an input image into a plurality of areas and obtains, based on a portion of the input image in each area, maximum luminances for the respective RGB colors in the area, as first light-emission luminances;

a weighting coefficient calculating unit that determines weighting coefficients to be used in calculation of second light-emission luminances, based on first light-emission luminances for the three RGB colors in the plurality of areas, the second-light emission luminances indicating luminances of light sources of the three RGB colors in each area upon light emission;

a light-emission luminance correcting unit that extracts, in each area, a color with a highest first light-emission luminance among the three RGB colors as a reference color, and determines, in the each area, second light-emission luminances for colors other than the reference color based on correction luminances obtained by multiplying the first light-emission luminance for the reference color by predetermined coefficients and the weighting coefficients;

a display data calculating unit that obtains display data for controlling light transmittances of the display elements, based on backlight control data and the input image, the backlight control data including data representing first light-emission luminances for the reference color and data representing second light-emission luminances for the colors other than the reference color which are determined by the light-emission luminance correcting unit;

a panel drive circuit that outputs, based on the display data, signals for controlling the light transmittances of the display elements to the display panel; and a backlight drive circuit that outputs, based on the backlight control data, signals for controlling luminances of the light sources to the backlight.

2. The image display device according to claim 1, wherein the light-emission luminance correcting unit determines, for each of the colors other than the reference color, a correction luminance for the color as a second light-emission luminance for the color when a first light-emission luminance for the color is lower than the correction luminance for the color.

3. The image display device according to claim 1, wherein the weighting coefficient calculating unit determines, for each of the three RGB colors, a maximum luminance mean value which is a mean value of first light-emission luminances in the plurality of areas, and calculates a weighting coefficient W for a color with a highest maximum luminance mean value among the three RGB colors by a following equation:

$$W=I\times(Ma/Mb)+m$$

where I and m represent constants which are set externally, Ma represents anyone of the maximum luminance mean values for the three RGB colors, and Mb represents any one of the maximum luminance mean values for the three RGB colors other than the Ma.

4. The image display device according to claim 3, wherein the Ma represents a second highest value among the maximum luminance mean values for the three RGB colors, and the Mb represents a highest value among the maximum luminance mean values for the three RGB colors.

5. The image display device according to claim 3, wherein the weighting coefficient calculating unit sets 1 to weighting coefficients for colors other than the color with the highest maximum luminance mean value among the three RGB colors.

6. The image display device according to claim 3, wherein when values for any two or three colors among the maximum luminance mean values for the three RGB colors are equal, the weighting coefficient calculating unit determines rankings of magnitude of the values in following priority rankings: the color B; the color G; and the color R.

7. An image display method for an image display device having a display panel including a plurality of display elements; and a backlight including a plurality of light sources of three RGB colors, the method comprising:

an in-area maximum luminance obtaining step of dividing an input image into a plurality of areas and obtaining, based on a portion of the input image in each area, maximum luminances for the respective RGB colors in the area, as first light-emission luminances;

a weighting coefficient calculating step of determining weighting coefficients to be used in calculation of second light-emission luminances, based on first light-emission luminances for the three RGB colors in the plurality of areas, the second-light emission luminances indicating luminances of light sources of the three RGB colors in each area upon light emission;

a light-emission luminance correcting step of extracting, in each area, a color with a highest first light-emission luminance among the three RGB colors as a reference color, and determining, in the each area, second light-emission luminances for colors other than the reference color based on correction luminances obtained by multiplying the first light-emission luminance for the reference color by predetermined coefficients and the weighting coefficients;

a display data calculating step of obtaining display data for controlling light transmittances of the display elements, based on backlight control data and the input image, the backlight control data including data representing first light-emission luminances for the reference color and data representing second light-emission luminances for the colors other than the reference color which are determined in the light-emission luminance correcting step;

a panel driving step of outputting, based on the display data, signals for controlling the light transmittances of the display elements to the display panel; and a backlight driving step of outputting, based on the backlight control data, signals for controlling luminances of the light sources to the backlight.

8. The image display method according to claim 7, wherein in the light-emission luminance correcting step, for each of the colors other than the reference color, a correction luminance for the color is determined as a second light-emission luminance for the color when a first light-emission luminance for the color is lower than the correction luminance for the color.

9. The image display method according to claim 7, wherein in the weighting coefficient calculating step, for each of the three RGB colors, a maximum luminance mean value which is a mean value of first light-emission luminances in the plurality of areas is determined, and a weighting coefficient W for a color with a highest maximum luminance mean value among the three RGB colors is calculated by a following equation:

$$W=I\times(Ma/Mb)+m$$

where I and m represent constants which are set externally, Ma represents anyone of the maximum luminance mean values for the three RGB colors, and Mb represents any one of the maximum luminance mean values for the three RGB colors other than the Ma.

10. The image display method according to claim 9, wherein the Ma represents a second highest value among the maximum luminance mean values for the three RGB colors, and the Mb represents a highest value among the maximum luminance mean values for the three RGB colors.

11. The image display method according to claim 9, wherein in the weighting coefficient calculating step, 1 is set to weighting coefficients for colors other than the color with the highest maximum luminance mean value among the three RGB colors.

12. The image display method according to claim 9, wherein in the weighting coefficient calculating step, when values for any two or three colors among the maximum luminance mean values for the three RGB colors are equal, rankings of magnitude of the values are determined in following priority rankings: the color B; the color G; and the color R.

* * * * *